US007803508B2

(12) United States Patent
Ishii et al.

(10) Patent No.: US 7,803,508 B2
(45) Date of Patent: Sep. 28, 2010

(54) TONER AS WELL AS DEVELOPER AND IMAGE FORMING METHOD USING THE SAME

(75) Inventors: Masayuki Ishii, Numazu (JP); Tsuneyasu Nagatomo, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 773 days.

(21) Appl. No.: 11/687,328

(22) Filed: Mar. 16, 2007

(65) Prior Publication Data

US 2007/0218387 A1 Sep. 20, 2007

(30) Foreign Application Priority Data

Mar. 17, 2006 (JP) ..... 2006-074800
Mar. 9, 2007 (JP) ..... 2007-060241

(51) Int. Cl.
*G03G 9/00* (2006.01)

(52) U.S. Cl. ..... 430/108.7; 430/123.51

(58) Field of Classification Search ..... 430/108.7, 430/123.51

See application file for complete search history.

(56) References Cited

U.S. PATENT DOCUMENTS

| | | | | |
|---|---|---|---|---|
| 6,696,211 | B2 * | 2/2004 | Yoshida et al. | 430/108.3 |
| 2006/0003244 | A1 * | 1/2006 | Grande et al. | 430/106.2 |
| 2006/0063081 | A1 | 3/2006 | Nagatomo, et al. | |
| 2006/0068313 | A1 | 3/2006 | Nakayama, et al. | |
| 2006/0240351 | A1 | 10/2006 | Sugiura, et al. | |

FOREIGN PATENT DOCUMENTS

| | | |
|---|---|---|
| CN | 1144097 C | 3/2004 |
| JP | 2001-66820 | 3/2001 |
| JP | 2007-72350 | 3/2007 |
| JP | 2007-79205 | 3/2007 |

OTHER PUBLICATIONS

U.S. Appl. No. 12/046,728, filed Mar. 12, 2008, Ishii, et al.
U.S. Appl. No. 11/852,778, filed Sep. 10, 2007, Nagatomo, et al.
U.S. Appl. No. 11/857,791, filed Sep. 19, 2007, Kojima, et al.
U.S. Appl. No. 12/260,493, filed Oct. 29, 2008, Sawada, et al.
Chinese Office Action dated Jun. 3, 2010 w/attached English translation.

* cited by examiner

*Primary Examiner*—Mark A Chapman
(74) *Attorney, Agent, or Firm*—Oblon, Spivak, McClelland, Maier & Neustadt, L.L.P.

(57) ABSTRACT

A toner which combines excellent cleaning ability, image quality and durability, as well as a developer and an image forming method using the toner are provided.

A toner comprising a toner base particle which comprises at least a binding resin and a colorant, and an external additive, wherein an external additive is a non-spherical amorphous silica particle and a major axis of the silica particle is 40 nm to 180 nm.

An aspect wherein the non-spherical amorphous silica particle has a true specific gravity of 1.8 to 2.3 and the silica particle is hydrophobilized and a hydrophobilization degree is 40 or more, and an aspect wherein the non-spherical amorphous silica particle is produced by a dry system and a mass reduction rate is 5% by mass or less when the silica particle is heated from 30° C. up to 250° C. are preferable.

14 Claims, 6 Drawing Sheets

TONER AS WELL AS DEVELOPER AND IMAGE FORMING METHOD USING THE SAME

BACKGROUND OF THE INVENTION

1. Field of the Invention

The present invention relates to a toner for developing an electrostatic charge image in electrographic methods, electrostatic recording methods and electrostatic printings, as well as a developer and an image forming method using the toner.

2. Description of the Related Art

Conventionally, a fine particle external additive with a size of several nm to several ten nm has been used for a toner for developing a latent electrostatic image, and in recent years, large diameter particles typified by large particle diameter silica have been used as additives. A function expected for such large particle diameter silica is to prevent the additive from being embedded in toner base particles to which the large particle diameter silica have adhered, against a load and stress from an outside. Its functionality has been often set forth mainly in terms of particle diameter.

Thus, the present inventors produced a toner using spherical large diameter particles placed in the market, and gave the load from the outside thereto in a test apparatus which mimicked an actual machine. Then, a phenomenon that the spherical large diameter particles tumbled and migrated on the surface of the toner base particles against the load and the stress from the outside was observed from morphological characteristics of the spherical large diameter particles. When an amount of the added spherical large diameter particles was small, its tendency became particularly remarkable. Thus, it was found that a purpose to prevent the additive from being embedded was not always accomplished.

Likewise, from a test using the toner base particles having fine asperities on the toner surface obtained by polymerization for enhancing a cleaning property, it was found that the large diameter particles migrated to concave portions in the asperities due to the load from the outside and did not exert the expected function.

Thus, in order to prevent such a tumbling phenomenon of the external additive on the surface of the toner base particles, a method of giving an effect on a rolling phenomenon by increasing the amount of the external additive to be added to increase a particle number receiving the load from the outside is proposed. According to this method, a certain effect on the outside load is obtained, but the rolling phenomenon of the particles on the surface of the toner base particles is not inhibited and the large particle diameter silica is dissociated from the toner surface to be sometimes free by the stress and friction in a developing device. Such a free external additive migrates together with the toner onto a photoconductor when the toner is developed on the photoconductor surface, remains on the photoconductor surface after the transfer, and sometimes adheres to the photoconductor surface without being cleaned. When the free external additive is accumulated on the photoconductor surface in this way, image quality on copies is sometimes defected (filming) or the photoconductor surface is sometimes injured to cause shortened lifetime of the photoconductor. The free external additive is spilled from the developing device upon development to stain inside a copy machine. Furthermore, the free external additive adheres onto a carrier surface during the development to inhibit giving and receiving the charge between the carrier and the toner, which is one factor which reduces the charge property of the toner.

In order to solve these problems, the method of fixing the large particle diameter silica to the surface of the toner base particles by giving a strong shear upon adding and mixing is proposed (see Japanese patent Application laid-Open (JP-A) No. 2001-066820). However, when the toner base particles having fine asperities on the toner surface obtained by polymerization are used, this propose is not necessarily effective, the large particle diameter silica migrates to concave portions in the asperities due to the strong shear and remains in non-functional sites on the surface of the toner base particles.

Therefore, it is an actual circumstance that it is desired to rapidly provide a toner which prevents the rolling phenomenon of the external additive on the surface of the toner base particles, can prevent the external additive from being embedded due to external stress and combines excellent cleaning ability, image quality and durability even in a small amount to be added, as well as a developer and an image forming method using the toner

BRIEF SUMMARY OF THE INVENTION

The present invention aims at solving conventional various problems and accomplishing the following object. That is, it is an object of the present invention to provide a toner which prevents a rolling phenomenon of an external additive on the surface of toner base particles, can prevent the external additive from being embedded due to external stress and combines excellent cleaning ability, image quality and durability even in a small amount to be added by using non-spherical amorphous large particle diameter silica particles as an external additive, as well as a developer and an image forming method using the toner.

Procedures for solving the above problems are as follows.

[1] A toner comprising a toner base particle which comprises at least a binding resin and a colorant, and an external additive, wherein an external additive is a non-spherical amorphous silica particle and a major axis of the silica particle is 40 nm to 180 nm.

[2] The toner according to claim 1, wherein said external additive is a non-spherical amorphous silica particle obtained by sintering multiple particles.

[3] The toner according to [1] above, wherein the major axis of the non-spherical amorphous silica particle is 60 nm to 140 nm.

[4] The toner according to [1] above, wherein the non-spherical amorphous silica particle has a true specific gravity of 1.8 to 2.3 and the silica particle is hydrophobilized wherein a hydrophobilization degree is 40 or more.

[5] The toner according to [1] above, wherein the non-spherical amorphous silica particle is produced by a dry system and a mass reduction rate when the silica particle is heated from 30° C. up to 250° C. is 5% by mass or less.

[6] The toner according to claim 1, containing at least one external additive having BET specific surface area of 20 $m^2/g$ to 300 $m^2/g$ besides said non-spherical amorphous silica particle.

[7] The toner according to claim 1, wherein the external additive besides said non-spherical amorphous silica particle is at least one selected from silica, titanium compounds, alumina, cerium oxide, calcium carbonate, magnesium carbonate, calcium phosphate, fluorine-containing resin fine particles, silica-containing resin fine particles, and nitrogen-containing resin fine particles.

[8] The toner according to [7] above, wherein the titanium compound is a titanium compound obtained by reacting at least a part of $TiO(OH)_2$ produced by a wet system with either a silane compound or a silicone oil.

[9] The toner according to [7] above, wherein a specific gravity of the titanium compound is 2.8 to 3.6.

[10] The toner according to [1] above obtained by emulsifying or dispersing a solution or a dispersion of toner materials in a water-based medium to prepare an emulsification or a dispersion, and subsequently granulating the toner.

[11] The toner according to [10] above, wherein the toner materials contains a compound containing an active hydrogen group and a polymer capable of reacting with the compound containing the active hydrogen group, and wherein granulation is performed by reacting the compound containing the active hydrogen group with the polymer capable of reacting with the compound containing the active hydrogen group to generate an adhesive substrate and obtaining particles comprising at least the adhesive substrate.

[12] The toner according to [10] above, wherein a solution or a dispersion of toner materials is prepared by dissolving or dispersing the toner materials in an organic solvent.

[13] The toner according to [1] above, wherein the toner is obtained by melting and kneading, and pulverizing the toner material containing at least the binding resin and the colorant.

[14] A two-component developer composed of a toner and a carrier, wherein the toner comprises a toner base particle which comprises at least a binding resin and a colorant, and an external additive, wherein an external additive is a non-spherical amorphous silica particle and a major axis of the silica particle is 40 nm to 180 nm.

[15] An image forming method comprising a latent electrostatic image forming step of forming a latent electrostatic image on a latent electrostatic image bearing member, a developing step of developing said latent electrostatic image using a toner to form a visible image, a transferring step of transferring said visible image on a recording medium and a fixing step of fixing a transfer image transferred onto the recording medium, wherein the toner comprises a toner base particle which comprises at least a binding resin and a colorant, and an external additive, wherein an external additive is a non-spherical amorphous silica particle and a major axis of the silica particle is 40 nm to 180 nm.

The toner of the present invention contains the toner base particles comprising the toner materials containing at least the binding resin, the colorant and a releasing agent, and a non-spherical amorphous silica particle as an external additive and a major axis of the silica particle is 40 nm to 80 nm. Thus, the rolling phenomenon of the external additive on the surface of the toner base particles is prevented, embedding of the external additive due to the external stress can be prevented, and the excellent cleaning ability, image quality and durability are combined even in a small amount to be added.

The developer of the present invention comprises the toner of the present invention. Thus, when an image is formed by the electrographic method using the developer, the excellent cleaning ability, image quality and durability are combined to form the image with high quality.

A vessel with toner of the present invention is filled with the toner of the present invention. Thus, when an image is formed by the electrographic method using the developer of the present invention filled in the vessel with toner, the excellent cleaning ability, image quality and durability are combined to form the image with high quality.

A process cartridge of the present invention has at least the latent electrostatic image bearing member and a developing unit which develops the latent electrostatic image formed on the latent electrostatic image bearing member using the toner of the present invention to form the visible image. The process cartridge is detachable to an image forming apparatus, is excellent in availability and uses the toner of the present invention. Thus, the excellent cleaning ability, image quality and durability are combined to form the image with high quality.

An image forming apparatus of the present invention has at least the latent electrostatic image bearing member, a latent electrostatic image forming unit, the developing unit, a transferring unit and a fixing unit. In the image forming apparatus, the latent electrostatic image forming unit forms the latent electrostatic image on the latent electrostatic image bearing member. The developing unit develops the latent electrostatic image using the toner of the present invention to form the visible image. The transferring unit transfers the visible image onto the recording medium. The fixing unit fixes the transfer image transferred onto the recording medium. As a result, the excellent cleaning ability, image quality and durability are combined to form the image with high quality.

The image forming method of the present invention comprises at least a latent electrostatic image forming step, a developing step, a transferring step and a fixing step. In the image forming apparatus, in the latent electrostatic image forming step, the latent electrostatic image is formed on the latent electrostatic image bearing member. In the developing step, the latent electrostatic image is developed using the toner of the present invention to form the visible image. In the transferring step, the visible image is transferred onto the recording medium. In the fixing step, the transfer image transferred onto the recording medium is fixed. As a result, the excellent cleaning ability, image quality and durability are combined to form the image with high quality.

According to the present invention, conventional various problems can be solved, and by using the non-spherical amorphous large particle diameter silica particle as the external additive, it is possible to provide the toner which prevents the rolling phenomenon of the external additive on the surface of the toner base particles, can prevent the external additive from being embedded due to the external stress and combines the excellent cleaning ability, image quality and durability even in a small amount to be added, as well as the developer and the image forming method using the toner.

DETAILED DESCRIPTION OF THE INVENTION

Toner

Figure 1:
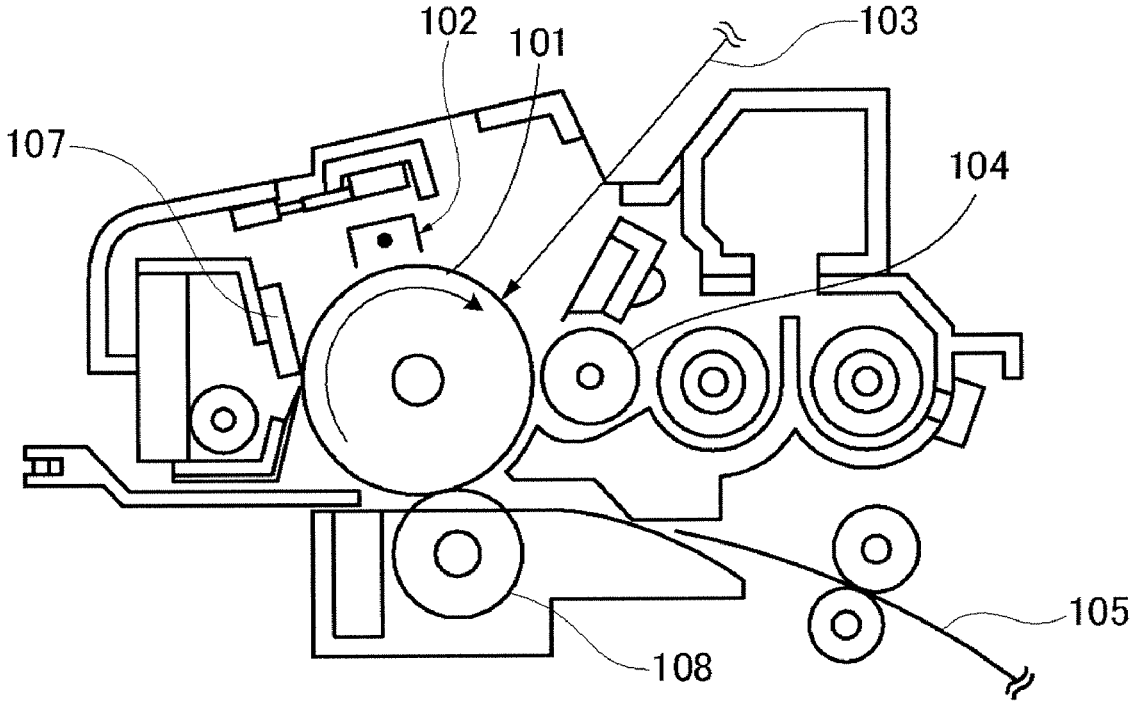
FIG. 1 is a schematic diagram showing one example of a process cartridge of the present invention.

The toner of the present invention has toner base particles comprising toner materials containing at least a binding resin, a colorant and a releasing agent, and at least two external additives, one of the external additives is a non-spherical amorphous silica particle, and the toner contains other component if necessary.

<External Additive>

A major axis of the non-spherical amorphous silica particles is preferably 40 nm to 180 nm and more preferably 60 nm to 140 nm. When the major axis is less than 40 nm, due to the stress given in a developing device, an additive itself is embedded in the surface of the toner base particles, and can not sometimes exert an expected function. When it exceeds 180 nm, it becomes difficult to strongly adhere onto the surface of the toner base particles, and the silica particles are sometimes peeled from the surface of the toner base particles due to the stress given in the developing device.

Here, the major axis of the non-spherical amorphous silica particle can be measured by observing an optional single particle using an observation procedure such as SEM and TEM and processing its image.

Sintering in the present invention refers to a state in which the particles formed of the same components are mutually adhered to integrate with losing their interface, and means the state in which the interface of the mutually adhered particles has disappeared and the particles have been homogenized.

The non-spherical amorphous silica particle obtained by sintering the multiple particles can be obtained by a method (so-called flame hydrolysis method) for producing a non-crystalline silica fine particle by introducing a gaseous silicon compound in flame to hydrolyze, by making a flame temperature a temperature equal to or higher than a melting point of silica and retaining a produced silica particle under high temperature equal to or higher than the melting point of silica for 0.30 seconds or more. Hereinafter, a time period for which the produced silica particle is retained under high temperature equal to or higher than the melting point of silica is referred to as a "retention time" simply. When the retention time is less than 0.3 seconds, the silica particles having a sharp particle size distribution are obtained, but no sintering occurs. By making the retention time 0.30 seconds or more, the sintering of the silica particles occurs during the retention time, and the non-spherical amorphous silica particles are obtained by attaching the multiple particles.

By making the retention time 30 second or more, the sintering occurs by starting from mutual fusion-bond of the produced silica particles during the retention time. Since the temperature in a retention environment is equal to or higher than the melting point of the silica particles, the non-spherical amorphous particle where the multiple particles have been attached by the sintering, which is different from a simple aggregate can be obtained.

The method of producing the external additive of the present invention is based on flame hydrolysis, and the silica particles are produced by introducing a raw material gas of a silicon compound into a flame to hydrolyze. As the raw material silicon compound, those such as silicon tetrachloride, trichlorosilane, cyclosilane and methyltrichlorosilane which are introduced in a gas state into oxygen hydrogen flame and afford a hydrolysis reaction under high temperature are used. These gaseous silicon compounds such as silicon tetrachloride are easily purified by distillation off and impurities in the raw material can be easily removed. Thus, the silica particles with high purity can be produced.

The flame is formed using the flammable gas and the gas susceptible to burn, and the flame temperature is elevated up to the temperature equal to or more than the melting point (1730° C.) of silica. As the flammable gas, it is possible to use hydrogen, hydrogen containing gases and hydrogen generating gases. As the gas susceptible to burn, it is possible to use oxygen and oxygen containing gases. When the flame temperature is lower than the melting point of silica, it is difficult to the silica particles having objective particle diameters.

These raw material gas (silicon compound gas), flammable gas and the gas susceptible to burn form the flame by a combustion burner. In the flame hydrolysis of the present invention, in order to assure the time period for which the produced silica particles retain under the high temperature equal to or higher than the melting point of silica, it is better to cover calorie lost due to radiation by combusting the flammable gas at an external periphery of the combustion burner. It is also preferable that a reaction vessel has a structure capable of withstanding the high temperature of 1000° C. or higher in order to keep the flame temperature equal to or higher than the melting point of silica, an exhaust fan is provided to an exhaust side to suck, and the pressure in the vessel is kept to a negative pressure of −200 mmAg to −10 mmAg from an atmospheric pressure standard.

A true specific gravity of the non-spherical amorphous silica particles is preferably 1.8 to 2.3. When the true specific gravity is less than 1.8, air space is present inside to weaken particle strength, or impurities are sometimes contained at a certain amount or more in the non-spherical amorphous silica particles. When it exceeds 2.3, the impurities are sometimes contained in the non-spherical amorphous silica particles.

Here, the true specific gravity can be measured by, for example, a dry mode automatic densimeter (AccuPyc 1330 supplied from Shimadzu Corporation).

It is preferable that the non-spherical amorphous silica particle is hydrophobilized and a hydrophobilization degree is 40 or more.

The hydrophobilization is not particularly limited, can be appropriately selected depending on the purpose, and includes, for example, the methods of treating with a silane coupling agent such as methyl trimethoxysilane, methyl triethoxysilane and octyl trimethoxysilane; or a silicone oil.

The silicone oil includes, for example, dimethyl silicone oil, methylphenyl silicone oil, chlorophenyl silicone oil, methylhydrogen silicone oil, alkyl modified silicone oil, fluorine modified silicone oil, polyether modified silicone oil, alcohol modified silicone oil, amino modified silicone oil, epoxy modified silicone oil, epoxy polyether modified silicone oil, phenol modified silicone oil, carboxy modified silicone oil, mercapto modified silicone oil, (meth) modified silicone oil and α-methylstyrene modified silicone oil.

The hydrophobilization degree of the hydrophobilized non-spherical amorphous silica particle is preferably 40 or more and more preferably 55 to 85. When the hydrophobilization degree is less than 40, fluidity of the toner under a high humidity environment is sometimes reduced, and the charge amount is sometimes reduced or decreased.

Here, the hydrophobilization degree can be measured by, for example, a powder wettability tester (WET-100P supplied from Rhesca Co., Ltd.)

It is preferable in terms of water content property of the formed silica particle that the non-spherical amorphous silica particle is produced by the dry system.

The mass reduction rate when the non-spherical amorphous silica particle is heated from 30° C. up to 250° C. is preferably 5% by mass or less, more preferably 0.05% by mass to 4.5% by mass and still more preferably 0.1% by mass to 4.0% by mass. When the mass reduction rate exceeds 5% by mass, the non-spherical amorphous silica particle liberated from the surface of the toner base particle due to the stress in the developing device adheres onto the surface of the carrier to cause the inhibition of charge imparting property of the carrier.

Here, the mass reduction rate can be obtained by, for example, using a DTA-Tg measurement apparatus (DTG-60 supplied from Shimadzu Corporation), heating from 30° C. up to 250° C. and measuring a percentage of the mass reduction of the non-spherical amorphous silica particles at that time.

An amount of the non-spherical amorphous silica particle to be added into the toner base particles is preferably 0.1 parts by mass to 5.0 parts by mass and more preferably 0.25 parts by mass to 3.0 parts by mass relative to 100 parts by mass of the total external additive.

The external additive in addition to the non-spherical amorphous silica particle used in the present invention is not particularly limited, can be appropriately selected depending on the purpose, and includes for example, silica (medium, small particle diameters), titanium compounds, alumina, cerium oxide, calcium carbonate, magnesium carbonate, calcium phosphate, fluorine-containing resin fine particles, silica-containing resin fine particles, and nitrogen-containing resin fine particles. These may be used alone or in combination of two or more.

The external additive preferably contains a titanium compound, and it is more preferably to obtain the titanium compound by reacting a part or all of $TiO(OH)_2$ produced by the wet system with the silane compound or the silicone oil.

As the silane compound, a silane coupling agent is suitably used. The silane coupling agent includes, for example, $CH_3Si(Cl)_3$, $CH_3Si(OCH_3)_3$, $CH_3Si(OC_2H_5)_3$, $CH_3CH_2Si(OCH_3)_3$, $CH_3(CH_2)_2Si(OCH_3)_3$, $CH_3(CH_2)_3Si(OCH_3)_3$, $CH_3(CH_2)_4Si(OCH_3)_3$, $CH_3(CH_2)_5Si(OCH_3)_3$, $CH_3(CH_2)_6Si(OCH_3)_3$, $CH_3(CH_2)_7Si(OCH_3)_3$, $CH_3(CH_2)_8Si(OCH_3)_3$, $CH_3(CH_2)_9Si(OCH_3)_3$, $CH_3(CH_2)_{10}Si(OCH_3)_3$, $CH_3(CH_2)_{11}Si(OCH_3)_3$, $CH_3(CH_2)_{12}Si(OCH_3)_3$, $CH_3(CH_2)_{13}Si(OCH_3)_3$, $CH_3(CH_2)_{14}Si(OCH_3)_3$, $CH_3(CH_2)_{15}Si(OCH_3)_3$, $CH_3(CH_2)_{16}Si(OCH_3)_3$, $CH_3(CH_2)_{17}Si(OCH_3)_3$, $CH_3(CH_2)_{18}Si(OCH_3)_3$, $CH_3(CH_2)_{19}Si(OCH_3)_3$, $CH_3(CH_2)_5Si(OC_2H_5)_3$, $CH_3(CH_2)_6Si,(OC_2H_5)_3$, $CH_3(CH_2)_7Si(OC_2H_5)_3$, $CH_3(CH_2)_8Si(OC_2H_5)_3$, $CH_3(CH_2)_9Si(OC_2H_5)_3$, $CH_3(CH_2)_{10}Si(OC_2H_5)_3$, $CH_3(CH_2)_{11}Si(OC_2H_5)_3$, $CH_3(CH_2)_{12}Si(OC_2H_5)_3$, $CH_3(CH_2)_{13}Si(OC_2H_5)_3$, $CH_3(CH_2)_{14}Si(OC_2H_5)_3$, $CH_3(CH_2)_{15}Si(OC_2H_5)_3$, $CH_3(CH_2)_{16}Si(OC_2H_5)_3$, $CH_3(CH_2)_{17}Si(OC_2H_5)_3$, $CH_3(CH_2)_{18}Si(OC_2H_5)_3$, $CH_3(CH_2)_{19}Si(OC_2H_5)_3$, $CF_3Si(OCH_3)_3$, $CH_3Si(NCO)_3$, $(CH_3)_2SiCl_2$, $(CH_3)_2Si(OCH_3)_2$, $(CH_3)_2Si(OC_2H_5)_2$, $(CH_3)(CH_3CH_2)Si(OCH_3)_2$, $(CH_3)[CH_3(CH_2)_2]Si(OCH_3)_2$, $(CH_3)[CH_3(CH_2)_3]Si(OCH_3)_2$, $(CH_3)[CH_3(CH_2)_4]Si(OCH_3)_2$, $(CH_3)[CH_3(CH_2)_5]Si(OCH_3)_2$, $(CH_3)[CH_3(CH_2)_6]Si(OCH_3)_2$, $(CH_3)[CH_3(CH_2)_7]Si(OCH_3)_2$, $(CH_3)[CH_3(CH_2)_8]Si(OCH_3)_2$, $(CH_3)[CH_3(CH_2)_9]Si(OCH_3)_2$, $(CH_3)[CH_3(CH_2)_{10}]Si(OCH_3)_2$, $(CH_3)[CH_3(CH_2)_{11}]Si(OCH_3)_2$, $(CH_3)[CH_3(CH_2)_{12}]Si(OCH_3)_2$, $(CH_3)[CH_3(CH_2)_{13}]Si(OCH_3)_2$, $(CH_3)[CH_3(CH_2)_{14}]Si(OCH_3)_2$, $(CH_3)[CH_3(CH_2)_{15}]Si(OCH_3)_2$, $(CH_3)[CH_3(CH_2)_{16}]Si(OCH_3)_2$, $(CH_3)[CH_3(CH_2)_{17}]Si(OCH_3)_2$, $(CH_3)[CH_3(CH_2)_{18}]Si(OCH_3)_2$, $(CH_3)[CH_3(CH_2)_{19}]Si(OCH_3)_2$, $(CH_3)_2Si(NCO)_2$, $(CH_3)_3SiCl$, $(CH_3)_3Si(OCH_3)$, $(CH_3)_3Si(OC_2H_5)$, $(CH_3)_2(CH_3CH_2)Si(OCH_3)$, $(CH_3)_2[CH_3(CH_2)_2]Si(OCH_3)$, $(CH_3)_2[CH_3(CH_2)_3]Si(OCH_3)$, $(CH_3)_2[CH_3(CH_2)_4]Si(OCH_3)$, $(CH_3)_2[CH_3(CH_2)_5]Si(OCH_3)$, $(CH_3)_2[CH_3(CH_2)_6]Si(OCH_3)$, $(CH_3)_2[CH_3(CH_2)_7]Si(OCH_3)$, $(CH_3)_2[CH_3(CH_2)_8]Si(OCH_3)$, $(CH_3)_2[CH_3(CH_2)_9]Si(OCH_3)$, $(CH_3)_2[CH_3(CH_2)_{10}]Si(OCH_3)$, $(CH_3)_2[CH_3(CH_2)_{11}]Si(OCH_3)$, $(CH_3)_2[CH_3(CH_2)_{12}]Si(OCH_3)$, $(CH_3)_2[CH_3(CH_2)_{13}]Si(OCH_3)$, $(CH_3)_2[CH_3(CH_2)_{14}]Si(OCH_3)$, $(CH_3)_2[CH_3(CH_2)_{15}]Si(OCH_3)$, $(CH_3)_2[CH_3(CH_2)_{16}]Si(OCH_3)$, $(CH_3)_2[CH_3(CH_2)_{17}]Si(OCH_3)$, $(CH_3)_2[CH_3(CH_2)_{18}]Si(OCH_3)$ and $(CH_3)_2[CH_3(CH_2)_{19}]Si(OCH_3)$.

The silicone oil includes, for example, dimethyl silicone oil, methylphenyl silicone oil, chlorophenyl silicone oil, methylhydrogen silicone oil, alkyl modified silicone oil, fluorine modified silicone oil, polyether modified silicone oil, alcohol modified silicone oil, amino modified silicone oil, epoxy modified silicone oil, epoxy polyether modified silicone oil, phenol modified silicone oil, carboxy modified silicone oil, mercapto modified silicone oil, (meth)acryl modified silicone oil and α-methylstyrene modified silicone oil.

The above reaction includes the method of immersing $TiO(OH)_2$ in the solution of these materials and drying. The treatment with the coupling agent includes, for example, the method of immersing $TiO(OH)_2$ fine particles in the solution containing the coupling agent and drying or the method of spraying the solution containing the coupling agent to $TiO(OH)_2$ fine particles and drying. The amount of the coupling agent to be adhered is preferably 0.1% by mass to 25% by mass relative to the $TiO(OH)_2$ fine particles. The specific gravity of the titanium compound is preferably 2.8 to 3.6.

The BET specific surface area of the external additive is preferably 10 $m^2/g$ to 300 $m^2/g$ and more preferably 20 $m^2/g$ to 200 $m^2/g$.

Here, the specific surface area can be calculated according to BET method using a specific surface area measurement apparatus ("Autosoap" supplied from Yuasa Ionics) by absorbing nitrogen gas to a sample surface and using a BET multipoint method.

An average particle diameter of the external additive is preferably 10 nm to 300 nm and more preferably 10 nm to 180 nm.

A content of the external additive in the toner is preferably 0.1% by weight to 8.0% by weight and more preferably 0.2% by weight to 3.0% by weight.

Here, the method of adding the external additive to the surface of the toner base particles may be either a dry system adding treatment or a wet system adding treatment.

In the dry system adding treatment, the external additive and the toner base particles are mixed and the external additive is adhered to the surface of the toner base particles.

The mixture can be performed by a publicly known mixer such as a V type blender, Henschel mixer and a hybridizer.

A peripheral speed of a rotation body of these apparatuses is not particularly limited, can be appropriately selected depending on the purpose, and to disperse and immobilize onto the toner surface, it is preferable to rotate at a slightly slow speed of about 35 m/s followed by rotating at 35 m/s to 55 m/s.

The stirring is not particularly limited, can be appropriately selected depending on the purpose, and is preferably performed at 15° C. to 40° C.

In the wet system external addition, the external additive and the toner base particles are dispersed in a water-based medium and the external additive is adhered to the toner particles.

In the wet system adding treatment, in the case of the dry toner, the toner base particles before dry system adding are dispersed in water using a surfactant if necessary. When the toner particles are formed in water, it is preferable to remove the surfactant used by washing and subsequently perform a wet system adding step. The excessive surfactant present in water is removed by solid liquid separation such as filtration and centrifugation, and a resulting cake or slurry is redispersed in the water-based medium. Furthermore, inorganic particles are added and dispersed in the slurry. The inorganic particles can also be previously dispersed in the water-based medium. At that time, if dispersed using the surfactant having a polarity opposed to a polarity of the surfactant used for making a water dispersion of the toner base particles, the external additive is efficiently adhered onto the toner particle surface. When the inorganic particles have been hydrophobilized and is hardly dispersed in a water-based dispersion, the inorganic particles may be dispersed by combining alcohol in a small amount to reduce a surface tension and be easily wetted.

Subsequently, the surfactant having the opposed polarity is gradually added with stirring. It is preferable to use the surfactant having the opposed polarity at 0.01% by mass to 1% by mass relative to the toner particle solid content. The charge of the inorganic fine particle dispersion in water is neutralized by adding the surfactant having the opposed polarity, and the inorganic fine particles can be aggregated and adhered onto the toner particle surface. It is preferable to use this inorganic fine particle at 0.01% by mass to 5% by mass relative to the toner particle solid content. Instead of gradually adding the surfactant having the opposed polarity with stirring, the inorganic fine particles can be adhered by shifting pH of the dispersion to an acid side or an alkali side.

These inorganic fine particles adhered onto the toner surface can be immobilized on the toner surface to prevent the dissociation by subsequently heating the slurry. At that time, it is preferable to heat at temperature higher than a glass transition temperature (Tg) of the resin which composes the toner. Furthermore, a heating treatment after drying may be performed with preventing the aggregation.

<Binding Resin>

The binding resin is not particularly limited, can be appropriately selected from those known publicly, and includes, for example, homopolymers and copolymers of styrenes such as styrene and chlorostyrene; monoolefins such as ethylene, propylene, butylene and isoprene; vinyl esters such as vinyl acetate, vinyl propionate, vinyl benzoate and vinyl butyrate; α-methylene fatty acid monocarboxylate esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone.

The Particularly representative binding resins include, for example, polystyrene resins, polyester resins, styrene-acrylic acid alkyl copolymers, styrene-methacrylic acid alkyl copolymers, styrene-acrylonitrile copolymers, styrene-butadiene copolymers, styrene-maleic acid anhydrate copolymers, polyethylene resins and polypropylene resins. These may be used alone or in combination of two or more.

Among them, the polyester resins are preferable, and urea-modified polyester resins are more preferable, and the combination of the urea-modified polyester resin and an unmodified polyester resin is the most preferable.

<Colorant>

The colorant is not particularly limited and can be appropriately selected from publicly known dyes and pigments depending on the purpose. For example, carbon black, nigrosine dyes, iron black, naphthol yellow S, hanza yellow (10 G, 5 G, G), cadmium yellow, yellow iron oxide, yellow ocher, chrome yellow, titanium yellow, polyazo yellow, oil yellow, hanza yellow (GR, A, RN, R), pigment yellow L, benzidine yellow (G, GR), permanent yellow (NCG), Balkan fast yellow (5 G, R), tartrazine lake, quinoline yellow lake, anthrazane yellow BGL, isoindolinone yellow, colcothar, red lead, lead vermillion, cadmium red, cadmium mercury red, antimony vermillion, permanent red 4R, parared, faicer red, parachloroorthonitroaniline red, lithol fast scarlet G, brilliant fast scarlet, brilliant carmine BS, permanent red (F2R, F4R, FRL, FRLL, F4RH), fast scarlet VD, Balkan fast rubine B, brilliant scarlet G, lithol rubine GX, permanent red F5R, brilliant carmine 6B, pigment scarlet 3B, Bordeaux 5B, toluidine maroon, permanent Bordeaux F2K, helio Bordeaux BL, Bordeaux 10B, bon maroon light, bon maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, non-metallic phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, pyridian, emerald green, pigment green B, naphthol green B, green gold, acid green lake, malachite green, phthalocyanine green, anthraquinone green, titanium oxide, zinc flower, and lithopone are included. These may be used alone or in combination of two or more.

The content of the colorant in the toner is not particularly limited, can be appropriately selected depending on the purpose, and is preferably 1% by mass to 15% by mass and more preferably 3% by mass to 10% by mass.

When the content is less than 1% by mass, a coloring force of the toner is reduced. When it exceeds 15% by mass, dispersion defect of pigments in the toner occurs, sometimes resulting in reducing the coloring force and reducing an electric property of the toner.

The colorant may be used a master batch complexed with the resin. The resin is not particularly limited, can be appropriately selected from those known publicly depending on the purpose, and includes, for example, polymers of styrene or substituents thereof, styrene based copolymers, polymethyl methacrylate, polybutyl methacrylate, polyvinyl chloride, polyvinyl acetate, polyethylene, polypropylene, polyester, epoxy resins, epoxy polyol resins, polyurethane, polyamide, polyvinyl butyral, polyacrylic acid resins, rosin, modified rosin, terpene resins, aliphatic hydrocarbon resins, alicyclic hydrocarbon resins, aromatic petroleum resins, chlorinated paraffin and paraffin wax. These may be used alone or in combination of two or more.

The polymers of styrene or the substituents thereof include, for example, polyester resins, polystyrene, poly-p-chlorostyrene and polyvinyl toluene. The styrene based copolymers include, for example, styrene-p-chlorostyrene copolymers, styrene-propylene copolymers, styrene-vinyl toluene copolymers, styrene-vinyl naphthalin copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro-methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene maleic acid copolymers and styrene-maleate ester copolymers.

The master batch can be produced by mixing or kneading the resin for the master batch and the colorant with a high shearing force. At that time, in order to enhance an interaction between the colorant ant the resin, it is preferable to add an organic solvent. A wet cake of the colorant can also be used directly for a so-called flushing method, and this is suitable in terms of no need of drying. This flushing method is the method in which an aqueous past of the colorant containing the water is mixed or kneaded together with the resin and the organic solvent, and the colorant is allowed to migrate to a resin side followed by removing the water content and the organic solvent component. A high shearing dispersing apparatus such as three roll mill is suitably used for the above mixing or kneading.

<Releasing Agent>

The releasing agent is not particularly limited, can be appropriately selected from those known publicly depending on the purpose, and suitably includes, for example, waxes.

The waxes include, for example, carbonyl group containing wax, polyolefin wax and long chain hydrocarbon. These may be used alone or in combination of two or more. Among them, the carbonyl group containing wax is preferable.

The carbonyl group containing wax includes, for example, polyalkanoate ester, polyalkanol ester, polyalkanoate amide, polyalkyl amide and dialkyl ketone. The polyalkanoate ester includes, for example, carnauba wax, montan wax, trimethylolpropane tribehenate, pentaerythritol tetrabehenate, pentaerythritol diacetate dibehenate, glycerine tribehenate and 1,18-octadecanediol distearate. The polyalkanol ester includes, for example, tristearyl trimellitate and distearyl maleate. The polyalkanoate amide includes, for example, dibehenyl amide. The polyalkyl amide includes, for example, tristearyl trimellitate amide. The dialkyl ketone includes, for example, distearyl ketone. Among these carbonyl group containing waxes, polyalkanoate ester is preferable.

Polyolefin wax includes, for example, polyethylene wax and polypropylene wax.

The long chain hydrocarbon includes, for example, paraffin wax and Sasol wax.

A melting point of the releasing agent is not particularly limited, can be appropriately selected depending on the purpose, and is preferably 40° C. to 160° C., more preferably 50° C. to 120° C. and particularly preferably 60° C. to 90° C. When the melting point is less than 40° C., the wax sometimes harmfully affects the heat resistant storage stability. When it exceeds 160° C., cold offset sometimes occurs easily when fixed at low temperature.

A melt viscosity of the releasing agent is preferably 5 cps to 1,000 cps and more preferably 10 cps to 100 cps as a measured value at temperature which is 20° C. higher than the melting point of the wax. When the melt viscosity is less than 5 cps, a releasing property is sometimes reduced. When it exceeds 1,000 cps, no enhancement effect on hot offset resistance and fixing property at low temperature is sometimes obtained.

The content of the releasing agent in the toner is not particularly limited, can be appropriately selected depending on the purpose, and is preferably 0% by mass to 40% by mass and more preferably 3% by mass to 30% by mass. When the content exceeds 40% by mass, a fluidity of the toner is sometimes deteriorated.

—Other Components—

The other components are not particularly limited, can be appropriately selected depending on the purpose, and include, for example, charge controlling agents, inorganic fine particles, fluidity enhancers, cleaning ability enhancers, magnetic materials and metal soaps.

The charge controlling agent is not particularly limited, can be appropriately selected from those known publicly depending on the purpose, and includes, for example, nigrosine based dyes, triphenylmethane based dyes, chromium containing metal complex dyes, molybdic acid chelate pigments, rhodamine based dyes, alkoxy based amine, quaternary ammonium salts (including fluorine modified quaternary ammonium salts), alkyl amide, a single body of phosphorus of compounds thereof, a single body of tungsten of compounds thereof, fluorine based active agents, metal salts of salicylic acid and metal salts of salicylate derivatives. These may be used alone or in combination of two or more.

As the charge controlling agent, commercially available products may be used. The commercially available products include, for example, Bontron 03 of the nigrosine dye, Bontron P-51 of the quaternary ammonium salt, Bontron S-34 of the metal-containing azo dye, E-82 of oxynaphthoic acid-based metal complex, E-84 of salicylic acid-based metal complexes, E-89 of phenol-based condensate (supplied from Orient Chemical Industries Ltd.); TP-302 and TP-415 of a quaternary ammonium salt molybdenum complexes (supplied from Hodogaya Chemical Co., Ltd.); Copy Charge PSY VP2038 of the quaternary ammonium salts, Copy Blue PR of the triphenylmethane derivative, Copy Charge NEG VP2036 and Copy Charge NX VP434 of the quaternary ammonium salts (supplied from Hoechst); LRA-901, LA-147 which is a boron complex (supplied from Japan Carlit Co., Ltd.) copper phthalocyanine, perylene, quinacridone, azo-based pigments, and polymer-based compounds having functional groups such as sulfonic acid group, carboxyl group and quaternary ammonium salt are included.

The content of the charge controlling agent in the toner varies depending on the type of the resin, the presence or absence of the additive and the dispersion method, can not be primarily defined, but is preferably 0.1 parts by mass to 10 parts by mass and more preferably 0.2 parts by mass to 5 parts by mass relative to 100 parts by mass of the binding resin. When the content is less than 0.1 parts by mass, the charge controlling property is not sometimes obtained. When it exceeds 10 parts by mass, the charge property of the toner becomes too large, the effect of the major charge controlling agent is reduced, and an electrostatic sucking force with the developing roller is increased, resulting in the reduction of fluidity of the developer and the reduction of the image density.

The inorganic fine particle can be used as the external additive for imparting the fluidity, developing property and charge property to the toner particles.

The inorganic fine particle is not particularly limited, can be appropriately selected from those known publicly depending on the purpose, and includes, for example, silica, alumina, titanium oxide, barium titanate, magnesium titanate, calcium titanate, strontium titanate, zinc oxide, tin oxide, quartz sand, clay, mica, sand-lime stone, diatom earth, chromium oxide, cerium oxide, colcothar, antimony trioxide, magnesium oxide, zirconium oxide, barium sulfate, barium carbonate, calcium carbonate, silicon carbide, and silicon nitride. These may be used alone or in combination of two or more.

A primary particle diameter of the inorganic fine particle is preferably 5 nm to 2 μm and more preferably 5 nm to 500 nm. The specific surface area of the inorganic fine particle by BET method is preferably 20 $m^2/g$ to 500 $m^2/g$.

The content of the inorganic fine particles in the toner is preferably 0.01% by mass to 5.0% by mass and more preferably 0.01% by mass to 2.0% by mass.

The fluidity enhancer means those capable of enhancing the hydrophobicity by performing the surface treatment to prevent the fluidity property and the charge property from deteriorating under high humidity, and includes, for example, silane coupling agents, silylation agents, alkyl fluoride group-containing silane coupling agents, organic titanate based coupling agents, aluminium based coupling agents, silicone oils and modified silicone oils. It is particularly preferable that the silica and the titanium oxide are used as hydrophobic silica and hydrophobic titanium oxide by performing the surface treatment with such a fluidity enhancer.

The cleaning ability enhancer is added to the toner for removing the developer left on the photoconductor and a primary transferring medium after the transfer, and includes, for example, metal salts of fatty acid such as stearic acid, e.g., zinc stearate and calcium stearate, and polymer fine particles produced by soap free emulsification polymerization, e.g., polymethyl methacrylate fine particles and polystyrene fine particles. The polymer fine particles preferably have a relatively narrow particle size distribution and a volume average particle diameter thereof is suitably 0.01 μm to 1 μm.

The magnetic material is not particularly limited, can be appropriately selected from those known publicly depending on the purpose, and includes, for example, iron powders, magnetite and ferrite. Among them, white ones are preferable in terms of color tone.

The toner of the present invention can be produced by pulverization methods and polymerization methods such as suspension polymerization method, emulsification polymerization method and melting suspension.

The pulverization method is the method of obtaining base particles of the toner by melting or kneading the toner materials, and pulverizing and classifying them. In the case of the pulverization method, for the purpose of enhancing an average circularity of the toner, a mechanical impact force may be given to the obtained toner base particles to control the shape. In this case, the mechanical impact force can be imparted to the toner base particles using an apparatus such as hybridizer and mechanofusion.

The above toner materials are mixed and the mixture is placed in a melting/kneading machine to melt and knead it. As the melting/kneading machine, uniaxial continuous kneaders, biaxial continuous kneaders, and batch system kneaders by roll mill can be used. For example, KTK type biaxial extruder supplied from Kobe Steel, Ltd., TEM type extruder supplied from Toshiba Machine Co., Ltd., the biaxial extruder supplied from KCA, PCM type biaxial extruder supplied from Ikegai Tekkosho and the kneader supplied from Bus are suitably used. It is preferable to perform this melting/kneading under a proper condition not to result in cleavage of a molecular chain of the binder resin. Specifically, a melting/kneading temperature is determined with reference to a softening point of the binder resin. When the temperature is much higher than the softening point, the cleavage is remarkable whereas when it is much lower than the softening point, the dispersion does not progress sometimes.

In the pulverization, the kneaded product obtained in the melting/kneading is pulverized. In this pulverization, it is preferable to first pulverize roughly and subsequently pulverize finely. At that time, the method of pulverizing by crushing to a crush plate in jet stream, the method of pulverizing by crushing particles one another in jet stream and the method of pulverizing in a narrow gap between a mechanically rotating rotor and stator are preferably used.

In the classification, a pulverized product obtained in the above pulverization is classified to adjust to particles having the given particle diameter. For example, the classification can be performed by removing a fine particle fraction by cyclone, decanter or centrifugation.

After completing the pulverization and classification, the pulverized product is classified in gas flow with a centrifugal force to produce the toner having the given particle diameters.

In the polymerization method, the toner can be obtained by emulsify or disperse a solution or a dispersion of the toner materials in a water-based medium to prepare an emulsion or a dispersion and subsequently granulating.

A preferable aspect of the toner of the present invention includes the toner obtained by emulsifying or dispersing a solution or a dispersion of the toner materials containing at least an active hydrogen group-containing compound and a polymer capable of reacting with the active hydrogen group-containing compound in the water-based medium, and reacting the active hydrogen group-containing compound with the polymer capable of reacting with the active hydrogen group-containing compound to generate particles containing at least an adhesive substrate.

Hereinafter, the toner in preferable aspects of the present invention will be described.

Solution or Dispersion of Toner Materials

The solution or the dispersion of the toner materials is obtained by dissolving or dispersing the toner materials in a solvent. The toner materials are not particularly limited as long as they can form the toner, can be appropriately selected depending on the purpose, and for example, comprise at least either the active hydrogen group-containing compound and the polymer (prepolymer) capable of reacting the active hydrogen group-containing compound, comprise the fixing aid, the colorant, preferably the wax, and further if necessary comprise the other components such as unmodified polyester resins, and releasing agents and charge controlling agents.

It is preferable that the solution or the dispersion of the toner materials is prepared by dissolving or dispersing the toner materials in an organic solvent. It is preferable to remove the organic solvent upon granulation or after the granulation of the toner.

The organic solvent is not particularly limited as long as it is the solvent capable of dissolving or dispersing the toner materials, can be appropriately selected depending on the purpose, and for example, one which has a boiling point of lower than 150° C. and is volatile is preferable in terms of easiness of its removal. For example, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone are included. It is preferable to be an ester based solvent, and ethyl acetate is particularly preferable. These may be used alone or in combination of two or more.

The amount of the organic solvent to be used is not particularly limited, can be appropriately selected depending on the purpose, and is preferably 40 parts by mass to 300 parts by mass, more preferably 60 parts by mass to 140 parts by mass and still more preferably 80 parts by mass to 120 parts by mass relative to 100 parts by mass of the toner materials.

In the method of producing the toner in the preferable aspects of the present invention, the solution or the dispersion of the toner materials can be prepared by dissolving or dispersing the toner materials e.g., the active hydrogen group-containing compound, the polymer capable of reacting with the active hydrogen group-containing compound, the fixing aid, the unmodified polyester resin, the wax, the colorant, the charge controlling agent, and the like in the organic solvent. In the toner materials, the components other than the polymer (prepolymer) capable of reacting with the active hydrogen group-containing compound may be added and mixed in the water-based medium in the preparation of the water-based medium described later, or may be added together with the solution or the dispersion in the water-based medium when the solution or the dispersion of the toner materials is added to the water-based medium.

Active Hydrogen Group-Containing Compound

The active hydrogen group-containing compound acts as an extending agent or a crosslinking agent when the polymer capable of reacting the active hydrogen group-containing compound performs an extending reaction or a crosslinking reaction in the water-based medium.

The active hydrogen group-containing compound is not particularly limited as long as it has the active hydrogen, and can be appropriately selected depending on the purpose. For example, when the polymer capable of reacting with the active hydrogen group-containing compound is a polyester prepolymer (A) having the isocyanate group, amines (B) is preferable because of being capable of making it have a high molecular weight by the extending reaction or the crosslinking reaction with the polyester prepolymer (A) containing the isocyanate group.

The active hydrogen group is not particularly limited, can be appropriately selected depending on the purpose, and includes hydroxyl groups (alcoholic hydroxyl groups and phenolic hydroxyl groups), amino groups, carboxyl groups and mercapto groups. These may be used alone or in combination of two or more. Among them, the alcoholic hydroxyl groups are preferable.

The amines (B) are not particularly limited, can be appropriately selected depending on the purpose, and include diamine (B1), trivalent or more polyamine (B2), amino alcohol (B3), aminomercaptan (B4) amino acids (B5) and those (B6) obtained by blocking amino group in the B1 to B5.

These may be used alone or combination of two or more. Among them, diamine (B1) or a mixture of diamine (B1) and trivalent or more polyamine (B2) in a small amount is particularly preferable.

Diamine (B1) includes aromatic diamine, alicyclic diamine, aliphatic diamine. Aromatic diamine includes phenylenediamine, diethyltoluenediamine and 4,4'-diaminodiphenylmethane. Alicyclic diamine includes 4,4'-diamino-3,3'-dimethyldicyclohexylmethane, diaminocyclohexane and isophoronediamine. Aliphatic diamine includes ethylenediamine, tetramethylenediamine and hexamethylenediamine.

Trivalent or more polyamine (B2) includes diethylenetriamine and triethylenetetraamine.

Amino alcohol (B3) includes ethanolamine and hydroxyethylaniline.

Aminomercaptan (B4) includes aminoethylmercaptan and aminopropylmercaptan.

Amino acid (B5) includes aminoproplonic acid and aminocaproic acid.

Those (B6) obtained by blocking the amino group in the (B1) to (B5) include ketimine compounds and oxazoline compounds obtained from amines in the (B1) to (B5) and ketones (acetone, methyl ethyl ketone, methyl isobutyl ketone).

To terminate the extending reaction or the crosslinking reaction of the active hydrogen group-containing compound with the polymer capable of reacting with the active hydrogen group-containing compound, a reaction terminator can be used. It is preferable to use the reaction terminator because the molecular weight of the adhesive substrate can be controlled in a desired range. The reaction terminator includes monoamine (diethylamine, dibutylamine, butylamine, laurylamine), or those (ketimine compounds) obtained by blocking them.

For the ratio of the prepolymer (A) containing the isocyanate group to amines (B), a mixed equivalent ratio [NCO]/[NHx] of the isocyanate group in the prepolymer (A) to the amino group [NHx] in amines (B) is preferably 1/3 to 3/1, more preferably 1/2 to 2/1 and particularly preferably 1/1.5 to 1.5/1.

When the mixed equivalent ratio [NCO]/[NHx] is less than 1/3, the fixing property at low temperature is sometimes reduced. When it is larger than 3/1, the molecular weight of the urea-modified polyester resin becomes small, and the hot offset resistance is sometimes deteriorated.

Polymer Capable of Reacting with Active Hydrogen Group-Containing Compound

The polymer (hereinafter sometimes also referred to as the "prepolymer") capable of reacting with the active hydrogen group-containing compound is not particularly limited as long as it has a site capable of reacting with the active hydrogen group-containing compound, can be appropriately selected from publicly known resins, and includes, for example, polyol resins, polyacryl resins, polyester resins, epoxy resins, and derivative resins thereof.

These may be used alone or in combination of two or more. Among them, the polyester resin is particularly preferable in terms of high fluidity upon melting and transparency.

The site capable of reacting with the active hydrogen group-containing compound is not particularly limited, can be appropriately selected from publicly known substituents, and includes, for example, isocyanate, epoxy, carboxyl and acid chloride groups.

These may be used alone or in combination of two or more. Among them, the isocyanate group is particularly preferable.

Among the prepolymers, urea bond generating group-containing polyester resins (RMPE) are particularly preferable because the molecular weight of a high molecular component is easily controlled, an oilless fixing property at low temperature can be assured, and in particular, in the case of having no releasing oil application mechanism to a heating medium for fixing, the good releasing property and fixing property can be assured.

The urea bond generating group includes, for example the isocyanate group. When the urea bond generating group in the urea bond generating group-containing polyester resin (RMPE) is the isocyanate group, the polyester resin (RMPE) particularly suitably includes the isocyanate group-containing polyester prepolymer (A).

The isocyanate group-containing polyester prepolymer (A) id not particularly limited, can be appropriately selected depending on the purpose, and includes, for example, polycondensates of polyol (PO) and polycarboxylic acid (PC), obtained by reacting the active hydrogen group-containing polyester resin with polyisocyanate (PIC).

The polyol (PO) is not particularly limited, can be appropriately selected depending on the purpose, and includes, for example, diol (DIO), trivalent or more polyol (TO) and mixtures of diol (DIO) and trivalent or more polyol (TO). These may be used alone or in combination of two or more. The diol (DIO) alone or the mixture of the diol (DIO) and the trivalent or more polyol (TO) in a small amount) is preferable.

The diol (DIO) includes, for example, alkylene glycol, alkylene ether glycol, alicyclic diol, alkylene oxide adducts of alicyclic diol, bisphenols and alkylene oxide adducts of bisphenols.

The alkylene glycol has preferably 2 to 12 carbon atoms, and includes, for example, ethylene glycol, 1,2-propylene glycol, 1,3-propylene glycol, 1,4-butanediol and 1,6-hexanediol. The alkylene ether glycol includes, for example, diethylene glycol, triethylene glycol, dipropylene glycol, polyethylene glycol, polypropylene glycol and polytetramethylene ether glycol. The alicyclic diol includes, for example, 1,4-cyclohexane dimethanol and hydrogenated bisphenol A. The alkylene oxide adducts of the alicyclic diol include adducts of alkylene oxide such as ethylene oxide, propylene oxide and butylene oxide. The bisphenols include, for example, bisphenol A, bisphenol F and bisphenol S. The alkylene oxide adducts of the bisphenols include, for example, those obtained by adding alkylene oxide such as ethylene oxide, propylene oxide and butylene oxide to the bisphenols.

Among them, alkylene glycol having 2 to 12 carbon atoms and alkylene oxide adducts of bisphenols are preferable. The alkylene oxide adducts of bisphenols, or the mixture of the alkylene oxide adducts of bisphenols and alkylene glycol having 2 to 12 is particularly preferable.

As the trivalent or more polyol (TO), trivalent to octavalent or more ones are preferable, and for example, trivalent or more polyvalent aliphatic alcohol, trivalent or more polyphenols, and alkylene oxide adducts of trivalent or more polyphenols are included.

The trivalent or more polyvalent aliphatic alcohol includes, for example, glycerine, trimethylolethane, trimethylolpropane, pentaerythritol and sorbitol. The trivalent or more polyphenols include, for example, trisphenol PA, phenol novolak and cresol novolak. The alkylene oxide adducts of trivalent or more polyphenols include, for example, those obtained by adding alkylene oxide such as ethylene oxide, propylene oxide and butylene oxide to the trivalent or more polyphenols.

In the mixture of the diol (DIO) and the trivalent or more polyol (TO), a mixed mass ratio (DIO:TO) of the diol (DIO) to the trivalent or more polyol (TO) is preferably 100:0.001 to 10 and more preferably 100:0.01 to 1.

The polycarboxylic acid (PC) is not particularly limited, can be appropriately selected depending on the purpose, and includes, for example, dicarboxylic acid (DIC), trivalent or more polycarboxylic acid (TC), and mixtures of dicarboxylic acid (DIC) and trivalent or more polycarboxylic acid (TC).

These may be used alone or in combination of two or more. Among them, dicarboxylic acid (DIC) alone or the mixture of DIC and trivalent or more polycarboxylic acid (TC) in a small amount is preferable.

The dicarboxylic acid includes, for example, alkylene dicarboxylic acid, alkenylene dicarboxylic acid and aromatic dicarboxylic acid.

The alkylene dicarboxylic acid includes, for example, succinic acid, adipic acid and sebacic acid. The alkenylene dicarboxylic acid preferably has 4 to 20 carbon atoms and includes, for example, maleic acid and fumaric acid. The aromatic dicarboxylic acid preferably has 8 to 20 carbon atoms and includes, for example, phthalic acid, isophthalic acid, terephthalic acid and naphthalene dicarboxylic acid.

Among them, alkenylene dicarboxylic acid having 4 to 20 carbon atoms and aromatic dicarboxylic acid having 8 to 20 carbon atoms are preferable.

The trivalent or more polycarboxylic acid (TO) is preferably trivalent to octavalent or more ones, and includes, for example, aromatic polycarboxylic acids.

The aromatic polycarboxylic acids preferably have 9 to 20 carbon atoms, and include, for example, trimellitic acid and pyromellitic acid.

As the polycarboxylic acid (PC), it is possible to also use acid anhydrate or lower alkyl ester of any ones selected from the dicarboxylic acid (DIC), the trivalent or more polycarboxylic acid (TC), and the mixture of the dicarboxylic acid (DIC) and the trivalent or more polycarboxylic acid (TC). The lower alkyl ester includes, for example, methyl ester, ethyl ester and isopropyl ester.

In the mixture of the dicarboxylic acid (DIC) and the trivalent or more polycarboxylic acid (TC), the mixed mass ratio (DIC:TC) of the dicarboxylic acid (DIC) to the trivalent or more polycarboxylic acid (TC) is not particularly limited, can be appropriately selected depending on the purpose, and for example, is preferably 100:0.01 to 10 and more preferably 100:0.01 to 1.

A mixed ratio when the polyol (PO) and the polycarboxylic acid (PC) are polycondensed is not particularly limited, can be appropriately selected depending on the purpose, and for example, an equivalent ratio ([OH]/[COOH]) of hydroxyl group [OH] in the polyol (PO) to carboxyl group [COOH] in the polycarboxylic acid (PC) is preferably 2/1 to 1/1 typically, more preferably 1.5/1 to 1/1 and particularly preferably 1.3/1 to 1.02/1.

The content of the polyol (PO) in the isocyanate group-containing polyester prepolymer (A) is not particularly limited, can be appropriately selected depending on the purpose, and is preferably 0.5% by mass to 40% by mass, more preferably 1% by mass to 30% by mass and particularly preferably 2% by mass to 20% by mass.

When the content is less than 0.5% by mass, the hot offset resistance is deteriorated, and it sometimes becomes difficult to balance the heat resistant storage stability and the fixing property at low temperature of the toner. When it exceeds 40% by mass, the fixing property at low temperature is sometimes deteriorated.

The polyisocyanate (PIC) is not particularly limited, can be appropriately selected depending on the purpose, and includes, for example, aliphatic polyisocyanate, alicyclic polyisocyanate, aromatic diisocyanate, aromatic aliphatic diisocyanate, isocyanurates, phenol derivatives thereof and those obtained by blocking them with oxime or caprolactam.

The aliphatic polyisocyanate includes, for example, tetramethylene diisocyanate, hexamethylene diisocyanate, 2,6-diisocyanatomethyl caproate, octamethylene diisocyanate, decamethylene diisocyanate, dodecamethylene diisocyanate, tetradecamethylene diisocyanate, trimethylhexane diisocyanate and tetramethylhexane diisocyanate. The alicyclic polyisocyanate includes, for example, isophorone diisocyanate and cyclohexylmethane diisocyanate. The aromatic diisocyanate includes, for example, trilene diisocyanate, diphenylmethane diisocyanate, 1,5-naphthylene diisocyanate, diphenyl-4,4'-diisocyanate, 4,4'-diisocyanato-3,3'-dimethyldiphenyl, 3-methyldiphenylmethane-4,4'-diisocyanate and diphenyl ether-4,4'-diisocyanate. The aromatic aliphatic diisocyanate includes, for example, $\alpha,\alpha,\alpha',\alpha'$-tetramethylxylylene diisocyanate. The isocyanurates includes, for example, tris-isocyanatoalkyl-isocyanurate and triisocyanatocycloalkyl-isocyanurate. These may be used alone or in combination of two or more.

For the mixed ratio when the polyisocyanate (PIC) is reacted with the active hydrogen group-containing polyester resin (e.g., hydroxyl group-containing polyester resin), the mixed equivalent ratio ([NCO]/[OH]) of the isocyanate group [NCO] in the polyisocyanate (PIC) to the hydroxyl group [OH] in the hydroxyl group-containing polyester resin is preferably 5/1 to 1/1 typically, more preferably 4/1 to 1.2/1 and particularly preferably 3/1 to 1.5/1.

When this ratio exceeds 5/1, the fixing property at low temperature is sometimes deteriorated. When it is less than 1, the offset resistance is sometimes deteriorated.

The content of the polyisocyanate (PIC) in the isocyanate group-containing polyester prepolymer (A) is not particularly limited, can be selected depending on the purpose, and is, for example, preferably 0.5% by mass to 40% by mass, more preferably 1% by mass to 30% by mass and still more preferably 2% by mass to 20% by mass.

When the content is less than 0.5% by mass, the hot offset resistance is deteriorated, and it sometimes becomes difficult to balance the heat resistant storage stability and the fixing property at low temperature. When it exceeds 40% by mass, the fixing property at low temperature is sometimes deteriorated.

An average number of the isocyanate group contained in one molecule of the isocyanate group-containing polyester prepolymer (A) is preferably one or more, more preferably 1.2 to 5 and still more preferably 1.5 to 4.

When the average number of the isocyanate group is less than 1, the molecular weight of the polyester resin (RMPE) modified with the urea bond-generating group becomes low, and the hot offset resistance is sometimes deteriorated.

A mass average molecular weight (Mw) of the polymer capable of reacting with the active hydrogen group-containing compound is preferably 3,000 to 40,000 and more preferably 4,000 to 30,000 in a molecular weight distribution by GPC (gel permeation chromatography) of a fraction soluble in tetrahydrofuran (THF). When the mass average molecular weight (Mw) is less than 3,000, the heat resistant storage stability is sometimes deteriorated. When it exceeds 40,000, the fixing property at low temperature is sometimes deteriorated.

The molecular weight distribution can be measured as follows by the gel permeation chromatography (GPC).

First, a column is stabilized in a heat chamber at 40° C. At this temperature, tetrahydrofuran (THF) is run at a flow rate of 1 mL/minute as a column solvent, and 50 μL to 200 μL of a tetrahydrofuran solution containing a sample adjusted at a concentration of 0.05% by mass to 0.6% by mass is injected to measure. Upon measurement of the molecular weight, the molecular weight distribution of the sample is calculated from the relation of logarithmic values of a standard curve made from several monodispersion polystyrene standard samples with counted numbers. As the standard samples for making the standard curve, monodispersion polystyrenes having molecular weights of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$ (supplied from Pressure Chemical or Toyo Soda Kogyo Co., Ltd.) are used, and it is preferable to use at least about 10 standard samples. As a detector, an RI (refractive index) detector can be used.

Water-Based Medium

The water-based medium is not particularly limited, can be appropriately selected from those known publicly and includes, for example, water, solvents miscible with the water, and mixtures thereof. Among them, the water is particularly preferable.

The solvent miscible with the water is not particularly limited as long as it is miscible with the water, and includes, for example, alcohol, dimethylformamide, tetrahydrofuran, cellsolves and lower ketones.

The alcohol includes, for example, methanol, isopropanol and ethylene glycol. The lower ketones include, for example, acetone and methyl ethyl ketone. These may be used alone or in combination of two or more.

The water-based medium can be prepared by dispersing the resin fine particles in the water-based medium. The amount of the resin fine particles to be added into the water-based medium is not particularly limited, can be appropriately selected depending on the purpose, and is preferably, for example, 0.5% by mass to 10% by mass.

The resin fine particle is not particularly limited as long as it can form an aqueous dispersion in the water-based medium, can be appropriately selected from publicly known resins depending on the purpose, may be a thermoplastic resin or a thermosetting resin, and includes, for example, vinyl resins, polyurethane resins, epoxy resins, polyester resins, polyamide resins, polyimide resins, silicon resins, phenol resins, melamine resins, urea resins, aniline resins, ionomer resins and polycarbonate resins.

These may be used alone or in combination of two or more. Among them, it is preferable to be formed of at least one selected from vinyl resins, polyurethane resins, epoxy resins and polyester resins because the aqueous dispersion of fine spherical resin particles is easily obtained.

The vinyl resin is the polymer obtained by homopolymerizing or copolymerizing a vinyl monomer(s), and includes styrene-(meth)acrylate ester resins, styrene-butadiene copolymers, (meth)acrylic acid-acrylate ester polymers, styrene-acrylonitrile copolymers, styrene-maleic acid anhydrate and styrene-(meth)acrylic acid copolymers.

As the resin fine particle, the copolymer comprising a monomer having at least two unsaturated groups can also be used. The monomer having at least two unsaturated groups is not particularly limited, can be appropriately selected depending on the purpose, and includes, for example, sodium salt of methacrylic acid ethylene oxide adduct sulfate ester ("Eleminol RS-30" supplied from Sanyo Chemical Industries, Ltd.), divinyl benzene and 1,6-hexanediol acrylate.

The resin fine particle can be obtained by polymerizing according to the publicly known method appropriately selected depending on the purpose, and it is preferable to obtain as the aqueous dispersion of the resin fine particles. The method of preparing the aqueous dispersion of the resin fine particles suitably includes, for example, (1) the method of directly producing the aqueous dispersion of the resin fine particles using the vinyl monomer as a starting material using any polymerization method selected from a suspension polymerization method, an emulsification polymerization method, a seed polymerization method and a dispersion polymerization method in the case of the vinyl resin; (2) the method of producing the aqueous dispersion of the resin fine particles by dispersing a precursor (monomer, oligomer) or a solvent solution thereof in the water-based medium in the presence of an appropriate dispersant, and subsequently heating or adding a curing agent to cure, in the case of polymerization resins or condensation resins of the polyester resin, polyurethane resin, or epoxy resin; (3) the method of dissolving an appropriate emulsifier in the precursor (monomer, oligomer) or the solvent solution thereof (preferably being a liquid or may be liquefied by heating) and subsequently adding water to emulsify with phase inversion, in the case of polymerization resins or condensation resins of the polyester resin, polyurethane resin, or epoxy resin; (4) the method of pulverizing the resin previously prepared by a polymerization reaction (may be any of addition polymerization, ring opening polymerization, polyaddition, addition condensation and polycondensation) using a mechanically rotary or jet pulverizer, then classifying to yield the resin fine particles, and subsequently dispersing them in water in the presence of the appropriate dispersant; (5) the method of yielding the resin fine particles by atomizing/spraying a resin solution in which the resin previously prepared by a polymerization reaction (may be any of addition polymerization, ring opening polymerization, polyaddition, addition condensation and polycondensation) has been dissolved and then dispersing them in water in the presence of the appropriate dispersant; (6) the method of precipitating the resin fine particles by adding a poor solvent to the resin solution in which the resin previously prepared by a polymerization reaction (may be any of addition polymerization, ring opening polymerization, polyaddition, addition condensation and polycondensation) has been dissolved or cooling the resin solution in which the resin has been previously dissolved with heating, subsequently removing the solvent to yield the resin fine particles, and then dispersing them in water in the presence of the appropriate dispersant; (7) the method of dispersing the resin solution in which the resin previously prepared by a polymerization reaction (may be any of addition polymerization, ring opening polymerization, polyaddition, addition condensation and polycondensation) has been dissolved in the solvent in the water-based medium in the presence of the appropriate dispersant, and subsequently removing the solvent by heating or reducing pressure; and (8) the method of dissolving the appropriate emulsifier in the resin solution in which the resin previously prepared by a polymerization reaction (may be any of addition polymerization, ring opening polymerization, polyaddition, addition condensation and polycondensation) has been dissolved in the solvent, and subsequently adding the water to emulsify with phase inversion.

Emulsification or Dispersion

For the emulsifying or dispersing the solution or the dispersion of the toner materials in the water-based medium, it is preferable to disperse the solution or the dispersion of the toner materials with stirring in the water-based medium. The dispersion method is not particularly limited, can be appropriately selected depending on the purpose, and can be performed, for example, using a dispersing machine. The dispersing machine includes the low speed shearing dispersing machine and the high speed shearing dispersing machine.

In the method of producing the toner of the preferable aspect of the present invention, the adhesive substrate (the above resin) is generated by performing the extending reaction or the crosslinking reaction between the active hydrogen group-containing compound and the polymer capable of reacting with the active hydrogen group-containing compound upon the emulsification or dispersion Adhesive Substrate The adhesive substrate exhibits an adhesiveness to the recording medium such as papers, comprises at least an adhesive polymer obtained by reacting the active hydrogen group-containing compound with the polymer capable of reacting with the active hydrogen group-containing compound, and may comprise a binding resin appropriately selected from publicly known binding resins.

The mass average molecular weight of the adhesive substrate is not particularly limited, can be appropriately selected depending on the purpose, and for example, is preferably 3,000 or more, more preferably 5,000 to 1,000,000 and particularly preferably 7,000 to 500,000.

When the mass average molecular weight is less than 3,000, the hot offset resistance is sometimes deteriorated.

A glass transition temperature (Tg) of the adhesive substrate is not particularly limited, can be appropriately selected depending on the purpose, and for example, is preferably 30° C. to 70° C. and more preferably 40° C. to 65° C. In the toner, since the polyester resin obtained by the crosslinking reaction or the extending reaction coexists, the toner exhibits the good storage stability even when the glass transition temperature is low compared with conventional polyester based toners.

When the glass transition temperature (Tg) is lower than 30° C., the heat resistant storage stability is sometimes deteriorated. When it is higher than 70° C., the fixing property at low temperature is sometimes insufficient.

The glass transition temperature can be measured using TG-DSC system TAS-100 (supplied from Rigaku Denki Co., Ltd.) by the following method. First, about 10 mg of a sample is placed in a sample vessel made from aluminium, which is then placed on a holder unit and set in an electric furnace. The temperature is raised from the room temperature up to 150° C. at a temperature rising speed of 10° C./minute, left stand at 150° C. for 10 minutes, then lowered to the room temperature and left stand for 10 minutes. DSC measurement was performed using a differential scanning calorimeter (DSC) by subsequently heating again up to 150° C. at a temperature rising speed of 10° C./minute under nitrogen atmosphere. The glass transition temperature (Tg) can be calculated from a tangent of an endothermic curve in the vicinity of the glass transition temperature (Tg) and a contact point with a base line using the analysis system in TAS-100 system.

Specific examples of the adhesive substrate are not particularly limited, can be appropriately selected depending on the purpose, and particularly suitably include polyester based resins.

The polyester based resins are not particularly limited, can be appropriately selected depending on the purpose, and particularly suitably include, for example urea modified polyester based resins.

The urea modified polyester based resin is obtained by reacting amines (B) as the active hydrogen group-containing compound with the isocyanate group-containing polyester prepolymer (A) as the polymer capable of reacting with the active hydrogen group-containing compound in the water-based medium.

The urea modified polyester based resin may comprise an urethane bond in addition to the urea bond. In this case, a molar ratio of the urea bond to the urethane bond (urea bond/urethane bond) is not particularly limited, can be appropriately selected depending on the purpose, and is preferably 100/0 to 10/90, more preferably 80/20 to 20/80 and particularly preferably 60/40 to 30/70. When the urea bond is less than 10, the hot offset resistance is sometimes deteriorated.

Specific examples of the urea modified polyester resin suitably include the following (1) to (10), i.e., (1) a mixture of one obtained by ureating with isophoronediamine a polyester prepolymer obtained by reacting a polycondensate of a bisphenol A ethylene oxide 2 mol adduct and isophthalic acid to isophorone diisocyanate, with the polycondensate of the bisphenol A ethylene oxide 2 mol adduct and isophthalic acid; (2) a mixture of one obtained by ureating with isophoronediamine a polyester prepolymer obtained by reacting a polycondensate of a bisphenol A ethylene oxide 2 mol adduct and isophthalic acid to isophorone diisocyanate, with a polycondensate of the bisphenol A ethylene oxide 2 mol adduct and terephthalic acid; (3) a mixture of one obtained by ureating with isophoronediamine a polyester prepolymer obtained by reacting a polycondensate of a bisphenol A ethylene oxide 2 mol adduct/bisphenol A propylene oxide 2 mol adduct and terephthalic acid to isophorone diisocyanate, with the polycondensate of the bisphenol A ethylene oxide 2 mol adduct/bisphenol A propylene oxide 2 mol adduct and terephthalic acid; (4) a mixture of one obtained by ureating with isophoronediamine a polyester prepolymer obtained by reacting a polycondensate of a bisphenol A ethylene oxide 2 mol adduct/bisphenol A propylene oxide 2 mol adduct and terephthalic acid to isophorone diisocyanate, with a polycondensate of the bisphenol A propylene oxide 2 mol adduct and terephthalic acid; (5) a mixture of one obtained by ureating with hexamethylenediamine a polyester prepolymer obtained by reacting a polycondensate of a bisphenol A ethylene oxide 2 mol adduct and terephthalic acid to isophorone diisocyanate, with the polycondensate of the bisphenol A ethylene oxide 2 mol adduct and terephthalic acid; (6) a mixture of one obtained by ureating with hexamethylenediamine a polyester prepolymer obtained by reacting a polycondensate of a bisphenol A ethylene oxide 2 mol adduct and terephthalic acid to isophorone diisocyanate, with the polycondensate of the bisphenol A ethylene oxide 2 mol adduct/bisphenol A propylene oxide 2 mol adduct and terephthalic acid; (7) a mixture of one obtained by ureating with ethylenediamine a polyester prepolymer obtained by reacting a polycondensate of a bisphenol A ethylene oxide 2 mol adduct and terephthalic acid to isophorone diisocyanate, with the polycondensate of the bisphenol A ethylene oxide 2 mol adduct and terephthalic acid; (8) a mixture of one obtained by ureating with hexamethylenediamine a polyester prepolymer obtained by reacting a polycondensate of a bisphenol A ethylene oxide 2 mol adduct and isophthalic acid to diphenylmethane diisocyanate, with the polycondensate of the bisphenol A ethylene oxide 2 mol adduct and isophthalic acid; (9) a mixture of one obtained by ureating with hexamethylenediamine a polyester prepolymer obtained by reacting a polycondensate of a bisphenol A ethylene oxide 2 mol adduct/bisphenol A propylene oxide 2 mol adduct and terephthalic acid/docenyl succinic acid anhydrate to diphenylmethane diisocyanate, with the polycondensate of the bisphenol A ethylene oxide 2 mol adduct/bisphenol A propylene oxide 2 mol adduct and terephthalic acid; and (10) a mixture of one obtained by ureating with hexamethylenediamine a polyester prepolymer obtained by reacting a polycondensate of a bisphenol A ethylene oxide 2 mol adduct and isophthalic acid to toluene diisocyanate, with the polycondensate of the bisphenol A ethylene oxide 2 mol adduct and isophthalic acid.

Binding Resin

The binding resin is not particularly limited, can be appropriately selected depending on the purpose, and includes, for example, polyester resins. In particular, the unmodified polyester resin (polyester resin which is not modified) is preferable.

When the unmodified polyester resin is contained in the toner, the fixing property at low temperature and the glossiness can be enhanced.

The unmodified polyester resin includes the same ones as in the urea bond generating group-containing polyester resin, i.e., the polycondensates of polyol (PO) and polycarboxylic acid (PC). The unmodified polyester resin is preferable in terms of fixing property at low temperature and hot offset resistance because the unmodified polyester resin is partially compatible with the urea bond generating group-containing polyester based resin (RMPE), i.e., they have a compatible similar structure.

The mass average molecular weight (Mw) of the unmodified polyester resin is preferably 1,000 to 30,000 and more preferably 1,500 to 15,000 in the molecular weight distribution by GPC (gel permeation chromatography of the fraction soluble in tetrahydrofuran (THF). When the mass average molecular weight (Mw) is less than 1,000, the heat resistant storage stability is sometimes deteriorated. Thus, it is preferable that the content of the component having the mass average molecular weight (Mw) of less than 1,000 is 8% by mass to 28% by mass. Meanwhile, when the mass average molecular weight exceeds 30,000, the fixing property at low temperature is sometimes deteriorated.

The glass transition temperature of the unmodified polyester resin is preferably 35° C. to 70° C. When the glass transition temperature is lower than 35° C., the heat resistant storage stability is sometimes deteriorated. When it is higher 70° C., the fixing property at low temperature is sometimes insufficient.

A hydroxyl group value of the unmodified polyester resin is preferably 5 mg KOH/g or more, more preferably 10 mg KOH/g to 120 mg KOH/g, and still more preferably 20 mg KOH/g to 80 mg KOH/g. When the hydroxyl group value is less than 5 mg KOH/g, it sometimes becomes difficult to balance the heat resistant storage stability and the fixing property at low temperature.

An acid value of the unmodified polyester resin is preferably 1.0 mg KOH/g to 30.0 mg KOH/g and more preferably 5.0 mg KOH/g to 20.0 mg KOH/g. Generally by making the toner have the acid value, the toner is easily charged negatively.

When the unmodified polyester resin is contained in the toner, the mixed mass ratio (RMPE/PE) of the urea bond generating group-containing compound (RMPE) to the unmodified polyester resin (PE) is preferably 5/95 to 25/75 and more preferably 10/90 to 25/75.

When the mixed mass ratio of the unmodified polyester resin exceeds 95, the hot offset resistance is sometime deteriorated. When it is less than 75, the fixing property at low temperature and glossiness of the image are sometimes deteriorated.

The content of the unmodified polyester resin in the binding resin is for example preferably 50% by mass to 100% by mass and more preferably 55% by mass to 95% by mass. When the content is less than 50% by mass, the fixing property at low temperature, a fixed image strength and the glossiness are sometimes deteriorated.

The adhesive substrate (e.g., the urea modified polyester resin), for example, (1) may be generated by emulsifying or dispersing the solution or the dispersion of the toner materials including the polymer (e.g., the isocyanate group-containing polyester prepolymer (A)) capable of reacting with the active hydrogen group-containing compound together with the active hydrogen group-containing compound (e.g., the amines (B)) in the water-based medium to form the oil drops, and subjecting both to the extending reaction or the crosslinking reaction in the water-based medium; (2) may be generated by emulsifying or dispersing the solution or the dispersion of the toner materials in the water-based medium in which the active hydrogen group-containing compound has been previously added to form the oil drops, and subjecting both to the extending reaction or the crosslinking reaction in the water-based medium; and (3) may be generated by adding and mixing the solution or the dispersion of the toner materials in the water-based medium, subsequently adding the active hydrogen group-containing compound to form the oil drops and subjecting both to the extending reaction or the crosslinking reaction from a particle interface in the water-based medium. In the above (3), the modified polyester resin is preferentially generated on the surface of the toner generated, and thus a density gradient can also be provided in the toner particles.

A reaction condition for generating the adhesive substrate by the emulsification or dispersion is not particularly limited, and can be appropriately selected depending on the combination of the polymer capable of reacting with the active hydrogen group-containing compound and the active hydrogen group-containing compound. A reaction time period is preferably 10 minutes to 40 hours and more preferably 2 hours to 24 hours.

The method of stably forming the dispersion body comprising the polymer (e.g., the isocyanate group-containing polyester prepolymer (A)) capable of reacting with the active hydrogen group-containing compound in the water-based medium includes, for example, the method of adding the solution or the dispersion of the toner materials prepared by dissolving or dispersing the toner materials, e.g., the polymer (e.g., the isocyanate group-containing polyester prepolymer (A)) capable of reacting with the active hydrogen group-containing compound, the colorant, the releasing agent, the charge controlling agent and the unmodified polyester resin in the organic solvent in the water-based medium, and dispersing them with a shearing force.

In the emulsification or dispersion, the amount of the water-based medium to be used is preferably 50 parts by mass to 2,000 parts by mass and more preferably 100 parts by mass to 1,000 parts by mass. When the amount to be used is less than 50 parts by mass, the dispersion of the toner materials is poor and the toner particle having the given particle diameter is not sometimes obtained. When it exceeds 2,000 parts by mass, production cost becomes high.

In the emulsification or dispersion, it is preferable to use a dispersant for stabilizing the oil drops and making the particle size distribution sharp with obtaining the desired shape.

The dispersant is not particularly limited, can be appropriately selected depending on the purpose, and includes, for example, surfactants, water hardly soluble inorganic compound dispersants and polymer based protection colloid. These may be used alone or in combination of two or more. Among them the surfactant is preferable.

The surfactant includes, for example, anion surfactants, cation surfactants, nonionic surfactants and ampholytic surfactants.

The anion surfactants includes, for example, alkylbenzene sulfonate salts, α-olefin sulfonate salts and phosphate salts. Among them, those having fluoroalkyl group are suitably included. The anion surfactants having the fluoroalkyl group include, for example, fluoroalkyl carboxylic acids having 2 to 10 carbon atoms or metal salts thereof, disodium perfluorooctanesulfonyl glutamate, 3-[omega-fluoroalkyl (C6 to 11) oxy]-1-alkyl (C3 to 4) sodium sulfonate, 3-[omega-fluoroalkanoyl (C6 to 8)-N-ethylamino]-1-propane sodium sulfonate, fluoroalkyl (C11 to 20) carboxylic acids or metal salts thereof, perfluoroalkyl carboxylic acids (C7 to 13) or metal salts thereof, perfluoroalkyl sulfonic acids (C4 to 12) or metal salts thereof, perfluorooctane sulfonic acid diethanolamide, N-propyl-N-(2-hydroxyethyl)perfluorooctane sulfonamide, perfluoroalkyl (C6 to 10) sulfonamide propyltrimethyl ammonium salts, perfluoroalkyl (C6 to 10)-N-ethylsulfonyl glycine salts and monoperfluoroalkyl (C6 to 10) ethyl phosphate ester. Commercially available surfactants having the fluoroalkyl group include, for example, Surflon S-111, S-112, S-113 (supplied from Asahi Glass Co., Ltd.), Fullard FC-93, FC-95, FC-98, FC-129 (supplied from Sumitomo 3M Ltd.), Unidain DS-101, DS-102 (supplied from Daikin Industries, Ltd.), Megafac F-110, F-120, F-113, F-191, F-812, F-833 (supplied from Dainippon Ink And Chemicals, Incorporated), F-Top EF-102, 103, 104, 105, 112, 123A, 123B, 306A, 501, 201, 204 (supplied from Tohchem Products Co., Ltd.), Ftergent F-100, F-150 (supplied from Neos Corporation).

The cation surfactants include, for example, amine salt type surfactants and quaternary ammonium salt type cation surfactants. The amine salt type surfactants include, for example, alkylamine salts, amino alcohol fatty acid derivatives, polyamine fatty acid derivatives and imidazoline. The quaternary ammonium salt type cation surfactants include, for example, alkyltrimethyl ammonium salts, dialkyldimethyl ammonium salts, alkyldimethylbenzyl ammonium salts, pyridinium salts, alkylisoquinolinium salts and benzethonium chloride. Among the cation surfactants, aliphatic primary, secondary and tertiary amine acids having the fluoroalkyl group, aliphatic quaternary ammonium salts such as perfluoroalkyl (C6 to 10) sulfonamide propyltrimethyl ammonium salts, benzalkonium salts, benzethonium chloride, pyridinium salts and imidazolium salts are included. Commercially available products of the cation surfactants include, for example, Surflon S-121 (supplied from Asahi Glass Co., Ltd.), Fullard FC-135 (supplied from Sumitomo 3M Ltd.), Unidain DS-202 (supplied from Daikin Industries, Ltd.), Megafac F-150, F-824 (supplied from Dainippon Ink And Chemicals, Incorporated), F-Top EF-132 (supplied from Tohchem Products Co., Ltd.) and Ftergent F-300(supplied from Neos Corporation).

The nonionic surfactants include, for example, fatty acid amide derivatives and polyvalent alcohol derivatives.

The ampholytic surfactants include, for example, alanine, dodecyldi(aminoethyl)glycine, di(octylaminoethyl)glycine and N-alkyl-N,N-dimethyl ammonium betaine.

The water hardly soluble inorganic compound dispersant includes, for example, tricalcium phosphate, calcium carbonate, titanium oxide, colloidal silica and hydroxyapatite.

The polymer based protection colloid includes, for example, homopolymers or copolymers of (meth)acryl based monomers having acids or hydroxyl group, vinyl alcohol or ethers with vinyl alcohol, esters of vinyl alcohol with compounds containing carboxyl group, amide compounds or methylol compounds thereof, chlorides or those having nitrogen atoms or its heterocycle, or polyoxyethylene based polymers and celluloses.

The acids include, for example, acrylic acid, methacrylic acid, α-cyanoacrylic acid, α-cyanomethacrylic acid, itaconic acid, crotonic acid, fumaric acid, maleic acid and maleic acid anhydrate. The (meth) acryl based monomers having the hydroxyl group include, for example, β-hydroxyethyl acrylate, α-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate ester, diethylene glycol monomethacrylate ester, glycerine monoacrylate ester, glycerine monomethacrylate ester, N-methylol acrylamide and N-methylol methacrylamide. The vinyl alcohol or ethers with vinyl alcohol include, for example, vinyl methyl ether, vinyl ethyl ether and vinyl propyl ether. The esters of vinyl alcohol with the compound containing the carboxyl group include, for example, vinyl acetate, vinyl propionate and vinyl butyrate. The amide compounds or the methylol compounds thereof include, for example, acrylamide, methacrylamide, diacetone acrylamide acid or the methylol compounds thereof. The chlorides include, for example, acrylic acid chloride and methacrylic acid chloride. The homopolymers or the copolymers of those having the nitrogen atom or its heterocycle include, for example, vinyl pyridine, vinyl pyrrolidone, vinyl imidazole and ethylene imine. The polyoxyethylene based polymers include, for example, polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene laurylphenyl ether, polyoxyethylene stearylphenyl ester and polyoxyethylene nonylphenyl ester. The celluloses include, for example, methyl cellulose, hydroxyethylcellulose and hydroxypropylcellulose.

In the preparation of the dispersion, a dispersion stabilizer can be used if necessary.

The dispersion stabilizer includes, for example, those such as calcium phosphate salt which are soluble in acid or alkali. When the dispersion stabilizer is used, the calcium phosphate salt can be removed by dissolving the calcium phosphate salt with the acid such as hydrochloric acid and washing with water or decomposing with an enzyme.

In the preparation of the dispersion, a catalyst for the extending reaction or the crosslinking reaction can be used. The catalyst includes, for example, dibutyl tin laurate and dioctyl tin laurate.

The organic solvent is removed from the emulsified slurry obtained in the emulsification or the dispersion.

The method of removing the organic solvent includes, for example, (1) the method of removing by raising the temperature in the entire reaction system to completely evaporate the organic solvent in the oil drops and (2) the method of completely removing the water insoluble organic solvent in the oil drops to form the toner fine particles by spraying the emulsified dispersion body in a dried atmosphere and simultaneously evaporating/removing the water-based dispersant.

When the organic solvent is removed, the toner particles are formed. The toner particles can be washed and dried. Subsequently, the classification can be performed as desired. The classification can be performed by removing the fine particle portion in liquid by cyclone, decanter or centrifugation. The classification may be performed after acquiring the powder after the drying.

By mixing the resulting toner particles together with the particles of the colorant, the releasing agent and the charge controlling agent or by further applying a mechanical impact force, it is possible to prevent the particles of the releasing agent from dissociating from the surface of the toner particles.

The method of applying the impact force includes the method of applying the impact force to the mixture using blades which rotate at high speed and the method of placing the mixture in high speed gas flow and crashing the particles one another or the complexed particles to an appropriate crash plate by accelerating. An apparatus used for this method includes Ang Mill (supplied from Hosokawa Micron Ltd.), an apparatus in which a pulverization air pressure has been reduced by remodeling I type mill (supplied from Nippon Pneumatic MFG. Co., Ltd.), a hybridization system (Nara Machinery Co., Ltd.), a cryptron system (supplied from Kawasaki Heavy Industries, Ltd.) and an automatic mortar.

The toner produced by the suspension polymerization method will be described below.

The toner produced by the suspension polymerization method can be obtained by emulsifying or dispersing (suspending) the solution or the dispersion of the toner materials in the water-based medium to prepare the emulsion or the dispersion (suspension) followed by granulating the toner as described above.

—Solution or Dispersion of Toner Materials—

In the suspension polymerization method, the solution or the dispersion of the toner materials is obtained by dissolving or dispersing the fixing aid, the colorant, if necessary, components, e.g., the wax, the charge controlling agent and the crosslinking agent in a polymerizable monomer and an oil soluble polymerization initiator. For example, in order to reduce the viscosity in the polymer produced in the polymerization reaction described later, the organic solvent, a macromolecular polymer and the dispersant may be appropriately added.

Polymerizable Monomer

A functional group can be introduced to the toner particle surface by partially using acids such as acrylic acid, methacrylic acid, α-cyanoacrylic acid, α-cyanomethacrylic acid, itaconic acid, crotonic acid, fumaric acid, maleic acid and maleic acid anhydrate; acrylamide, methacrylamide, diacetone acrylamide or the methylol compounds thereof; vinyl pyridine, vinyl pyrrolidone, vinyl imidazole, ethylene imine, acrylate or methacrylate having amino group such as diethylaminoethyl methacrylate. The dispersant can be absorbed and left onto the toner particle surface to introduce the functional group by appropriately selecting one having the acid group or the basic group as the dispersant to be used.

The polymerizable monomer includes, for example, styrene based monomers such as styrene, o-methylstyrene, m-methylstyrene, p-methylstyrene, p-methoxystyrene and p-ethylstyrene; acrylate esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylate esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; other acrylonitrile, methacrylonitrile and acrylamide.

The resin can also be used in addition to the polymerizable monomer. For example, the polymerizable monomer is water soluble, is dissolved in the aqueous dispersion and the emulsification polymerization can not be performed. Thus, when the polymerizable monomer which contains the hydrophilic functional group such as amino, carboxylate, hydroxyl, sulfone, glycidyl or nitrile is introduced in the toner, the resin which is the copolymer such as a random copolymer, a block copolymer or a graft copolymer of styrene or ethylene therewith, or the polycondensate of polyester or polyamide therewith, or the polyaddition polymer of polyether or polyimine therewith can be used.

The alcohol component and the acid component which form the polyester resin include the followings.

The alcohol component includes, for example, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexane dimethanol, butenediol, octenediol, cyclohexene dimethanol and hydrogenated bisphenol A. Polyvalent alcohol such as glycerine, pentaerythritol, sorbit, sorbitan and oxyalkylene ether of novolak type phenol resins may also be used.

The acid component includes, for example, benzene dicarboxylic acids such as phthalic acid, terephthalic acid and isophthalic acid or anhydrates thereof; alkyl carboxylic acids such as succinic acid, adipic acid, sebacic acid and azelaic acid or anhydrates thereof; succinic acid substituted with alkyl or alkenyl having 6 to 18 carbon atoms or anhydrates thereof; and unsaturated carboxylic acids such as fumaric acid, maleic acid, citraconic acid and itaconic acid or anhydrates thereof as bivalent carboxylic acids. Polyvalent carboxylic acids such as trimellitic acid, pyromellitic acid, 1,2,3,4-butane tetracarboxylic acid and benzophenone tetracarboxylic acid and anhydrates thereof may also be used.

The contents of the alcohol component and the acid component in the polyester resin is preferably 45 mol % to 55 mol % and 55 mol % to 45 mol %, respectively.

Two or more of the polyester resins may be combined as long as no harmful effect is given to physical properties of the toner. The physical properties can be controlled by modifying with silicone or the fluoroalkyl group-containing compound.

When a macromolecular polymer comprising such a polar functional group is used here, the average molecular weight of the macromolecular polymer is preferably 5,000 or more.

Furthermore, in addition to the polymerizable monomer, it is possible to use the resins shown below. The resins include, for example, homopolymers of styrene and substituents thereof, e.g., polystyrene and polyvinyl toluene; styrene based copolymers such as styrene-propylene copolymers, styrene-vinyl toluene copolymers, styrene-vinyl naphthaline copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers and styrene maleate ester copolymers; polymethyl methacrylate, polybutyl methacrylate, polyvinyl acetate, polyethylene, polypropylene, polyvinyl butyral, silicone resins, polyester resins, polyamide resins, epoxy resins, polyacrylic acid resins, rosin, modified rosin, terpene resins, phenol resins, aliphatic or alicyclic hydrocarbon resins, and aromatic petroleum resins. These may be used alone or in combination of two or more.

The amount of the resin to be added is preferably 1 part by mass to 20 parts by mass relative to 100 parts by mass of the polymerizable monomer. When the amount to be added is less than 1 part by mass, no effect by its addition is sometimes elicited on the control of the physical property of the toner particles. When it exceeds 20 parts by mass, it sometimes becomes difficult to design the physical property of the toner particles. The polymer having the different molecular weight from the molecular weight range of the toner obtained by polymerizing the polymerizable monomer can also be dissolved in and polymerized with the polymerizable monomer.

Oil Soluble Polymerization Initiator

When the polymerization reaction is performed using 0.5 parts by mass to 20 parts by mass of the oil soluble polymerization initiator having a half life of 0.5 hours to 30 hours upon polymerization reaction relative to 100 parts by mass of the polymerizable monomer, it is possible to yield the polymer having the maximum molecular weight between 10,000 to 100,000, and impart the desirable strength and the appropriate solubility to the toner.

The oil soluble polymerization initiator is not particularly limited as long as it is oil soluble, can be appropriately selected depending on the purpose, and includes, for example, azo based or diazo based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; and peroxide based polymerization initiators such as benzoyl peroxide, methyl ethyl ketone peroxide, diisopropyl peroxycarbonate, cumenehydroxy peroxide, 2,4-dichlorobenzoyl peroxide, lauroyl peroxide and t-butylperoxy-2-ethylhexanoate.

The crosslinking agent is not particularly limited, can be appropriately selected depending on the purpose, compounds mainly having two or more polymerizable double bonds can be suitably used, and for example, aromatic divinyl compounds such as divinyl benzene and divinyl naphthalene; carboxylate ester having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having 3 or more vinyl groups. These may be used alone or in combination of two or more.

The amount of the crosslinking agent to be added is preferably 0.01 parts by mass to 15 parts by mass relative to 100 parts by mass of the polymerizable monomer.

Water-Based Medium

The water-based medium is not particularly limited, can be appropriately selected depending on the purpose, and includes, for example water.

It is preferable that the water-based medium comprises the dispersion stabilizer.

As the dispersion stabilizer, for example, it is possible to use publicly known surfactants, organic dispersants and inorganic dispersants. Among them, the inorganic dispersant is preferable because harmful ultrafine particles are hardly produced, the dispersion stability is obtained by steric hindrance, thus the stability is kept even when the reaction temperature is changed, washing is easy and no harmful effect is given to the toner.

The inorganic dispersant includes, for example, polyvalent phosphate metal salts such as calcium phosphate, magnesium phosphate, aluminium phosphate and zinc phosphate; carbonate salts such as calcium carbonate and magnesium carbonate; inorganic salts such as calcium metasilicate, calcium sulfate and barium sulfate; inorganic oxides such as calcium hydroxide, magnesium hydroxide, aluminium hydroxide, silica, bentonite and alumina.

The inorganic dispersant can be directly used, but in order to obtain finer particles, the inorganic dispersant particles may be generated and used in the water-based medium. For example, in the case of the calcium phosphate, water insoluble calcium phosphate can be generated by mixing an aqueous solution of sodium phosphate and an aqueous solution of calcium chloride under stirring at high speed, and the more homogenous and finer dispersion becomes possible. At that time, a water soluble sodium chloride salt is produced simultaneously. This is preferable because when the water soluble salt is present in the water-based medium, the dissolution of the polymerizable monomer in water is inhibited and ultrafine toner particles due to the emulsification polymerization are hardly produced. However, this becomes an obstacle when the remaining polymerizable monomer is removed at the end of the polymerization reaction. Thus, it is preferable to exchange the water-based medium or perform desalting using an ion exchange resin. The inorganic dispersant can be nearly completely removed by dissolving with acid or alkali after the completion of the polymerization.

It is preferable that 0.2 parts by mass to 20 parts by mass of the inorganic dispersant alone is used relative to 100 parts by mass of the polymerizable monomer. When the inorganic dispersant is used, although the ultrafine particles are hardly produced, the toner having the small particle diameter is also hardly obtained. Thus it is preferable to combine 0.001 parts by mass to 0.1 parts by mass of the surfactant.

The surfactant includes, for example, sodium dodecylbenzene sulfate, sodium tetradecyl sulfate, sodium pentadecyl sulfate, sodium octyl sulfate, sodium oleate, sodium laurate, sodium stearate and potassium stearate.

Suspension

The suspension is performed by emulsifying or dispersing the solution or the dispersion in which the toner materials have been uniformly dissolved or dispersed in the water-based medium. At that time, the toner having the sharp particle size distribution is obtained by dispersing to the desired size of the toner at once using a high speed dispersing machine such as a high speed agitator or an ultrasonic dispersing machine.

The oil soluble polymerization initiator may be added simultaneously with the addition of other additives in the polymerizable monomer, or may be mixed just before suspending the solution of the dispersion of the toner materials in the water-based medium. Alternatively, the oil soluble polymerization initiator dissolved in the polymerizable monomer or the solvent can also be added during or immediately after the granulation of the toner or before starting the polymerization reaction.

Granulation

The granulation is performed by polymerizing the polymerizable monomer.

The temperature in the polymerization reaction is for example 40° C. or above, and generally 50° C. to 90° C. When the polymerization is performed at the temperature range, the releasing agent and the wax to be present inside the toner particle can be precipitated by phase separation and enfolded in the particle. In order to consume the remaining polymerizable monomer, the reaction temperature is sometimes set at 90° C. to 150° C. However, as described above, when heated to the temperature equal to or higher than the melting point of the fixing aid, the resin and the fixing aid become compatible. Thus, it is necessary to react at the temperature lower than the melting point of the fixing aid. Specifically, it is preferable to react at 100° C. or below.

The seed polymerization method in which the polymerizable monomer is further absorbed to the resulting polymerized particles, and subsequently the polymerization is performed using the oil soluble polymerization initiator can also be used in the above granulation. At that time, the compound having the polarity can also be dissolved or dispersed in the polymerizable monomer to be absorbed to use.

After the completion of the polymerization reaction, it is preferable to stir at a stirring speed at which a particle state is kept and suspension or precipitation of the particles is prevented using an ordinary stirrer.

The toner particle is obtained by filtrating and washing the polymerized particle after the completion of the polymerization reaction to remove the surfactant, drying, and further mixing with the inorganic powder to adhere onto the particle surface. At that time, it is preferable to remove rough powders and fine powders by classifying.

In the toner of the present invention, it is preferable to add the inorganic fine powder having a number average primary particle diameter of 4 nm to 80 nm as a fluidization agent.

The inorganic fine powder includes, for example, silica, alumina and titanium oxide.

The silica includes, for example, dry silica referred to as so-called dry system or fumed silica produced by vapor phase oxidation of silicon halide as silicate fine powder and so-called wet silica produced from liquid glass. Among them, dry silica having less silanol group on the surface and inside the silica fine powder and less production residues such as $Na_2O$ and $SO_3$ is preferable. In dry silica, by using a metal halogen compound such as aluminium chloride or titanium chloride together with a silicon halogen compound, it is possible to obtain composite fine powder of the silica and the other metal oxide, which can also be used.

In the inorganic fine powder, the specific surface area measured by BET method by nitrogen absorption is preferably 20 $m^2/g$ to 350 $m^2/g$ and more preferably 25 $m^2/g$ to 300 $m^2/g$ for imparting the good fluidity to the toner.

The specific surface area can be calculated according to BET method using a specific surface area measurement apparatus ("Autosoap 1" supplied from Yuasa Ionics) by absorbing nitrogen gas to a sample surface and using a BET multipoint method.

The content of the inorganic fine powder is preferably 0.1% by mass to 3.0% by mass relative to the toner base particles. When the content is less than 0.1% by mass, the fluidity is sometimes insufficient. When it exceeds 3.0% by mass, the fixing property is sometimes deteriorated.

The content of the inorganic fine powder can be quantified, for example, utilizing a fluorescence X ray analysis using a standard curve made from standard samples.

It is preferable that the inorganic fine powder is hydrophobilized because excellent properties can be kept under high temperature and high humidity environments.

A treating agent in the hydrophobilization includes, for example, silicone varnish, various modified silicone varnishes, silicone oil, various modified silicone oils, silane compounds, silane coupling agents, other organic silicon compounds and organic titanium compounds. These may be used alone or in combination of two or more.

The method of the hydrophobilization includes, for example, the method in which a silylation reaction as a first reaction is performed to induce disappearance of the silanol group by chemical bond, and subsequently the hydrophobilization is performed by forming a hydrophobic thin film on the surface by the silicone oil as a second reaction.

The viscosity of the silicone oil at 25° C. is, for example, preferably 10 $mm^2/s$ to 200,000 $mm^2/s$ and more preferably 3,000 $mm^2/s$ to 80,000 $mm^2/s$.

When the viscosity is less than 10 $mm^2/s$, the performance of the inorganic fine powder becomes unstable, and the image quality is sometimes deteriorated due to heat and mechanical stress. When it exceeds 200,000 $mm^2/s$, the uniform hydrophobilization sometimes becomes difficult.

The silicone oil suitably includes, for example, dimethyl silicone oil, methylphenyl silicone oil, α-methylstyrene modified silicone oil, chlorophenyl silicone oil and fluorine modified silicone oil.

As the method of using the silicone oil, for example, silica treated with the silane compound and the silicone oil may be directly mixed using a mixer such as Henschel mixer, the silicone oil may be sprayed to silica, or the silicone oil may be dissolved or dispersed in the appropriate solvent, subsequently the silica powder may be added and the solvent may be removed. Among them, the method using a spray is preferable because the relatively low amount of aggregates of the inorganic fine powder is produced.

The amount of the silicone oil to be added is preferably 1 part by mass to 40 parts by mass and more preferably 3 parts by mass to 35 parts by mass relative to 100 parts by mass of the silica.

In the toner of the present invention, its physical properties such as shape and size are not particularly limited, can be appropriately selected depending on the purpose, and it is preferable to have the following volume average particle diameter (Dv), and volume average particle diameter (Dv)/number average particle diameter (Dn).

The volume average particle diameter (Dv) of the toner is, for example, preferably 3 μm to 8 μm and more preferably 4 μm to 6 μm.

When the volume average particle diameter is less than 3 μm, in the two-component developer, the toner is sometimes fusion-bonded to the carrier surface in long term stirring in the developing apparatus to reduce charging performance of the carrier. In the one-component developer, the filming of the toner to the developing roller easily occurs and the fusion-bond of the toner to the member such as blade easily occurs due to making the toner a thin layer. When it exceeds 8 μm, it becomes difficult to obtain the image with high resolution and high quality, and the particle diameters of the toner is sometimes largely altered when the toner is consumed and supplied during the development.

A ratio of the volume average particle diameter (Dv) to the number average particle diameter (Dn) (Dv/Dn) is, for example, preferably 1.30 or less and more preferably 1.00 to 1.30.

When the ratio (Dv/Dn) of the volume average particle diameter to the number average particle diameter is less than 1.00, in the two-component developer, the toner is sometimes fusion-bonded to the carrier surface in the long term stirring in the developing apparatus to reduce the charging performance of the carrier, and the cleaning ability is sometimes deteriorated. In the one-component developer, the filming of the toner to the developing roller easily occurs and the fusion-bond of the toner to the member such as blade easily occurs due to making the toner a thin layer. When it exceeds 1.30, it becomes difficult to obtain the image with high resolution and high quality, and the particle diameters of the toner is sometimes largely altered when the toner is consumed and supplied during the development.

When the ratio (Dv/Dn) of the volume average particle diameter to the number average particle diameter is 1.00 to 1.30, the toner is excellent in any of storage stability, fixing property at low temperature and hot offset resistance, and particularly excellent in image glossiness when used for the full color copy machine. In the two-component developer, even when the toner is consumed and supplied for a long time, variation of the toner particle diameters during the development is small. The good and stable developing property is obtained in the long term stirring in the developing apparatus. In the one-component developer, even when the toner is consumed and supplied, the variation of the toner particle diameters is small as well as there is no filming of the toner to the developing roller and no fusion-bond of the toner to the member such as blade for making the toner the thin layer. The good and stable developing property is obtained in the long term use (stirring) of the developing apparatus. Thus, the image with high quality can be obtained.

The volume average particle diameter and the ratio (Dv/Dn) of the volume average particle diameter to the number average particle diameter can be measured, for example, using a particle size measurement apparatus "Multisizer II" supplied from Beckman Coulter.

Coloration of the toner of the present invention is not particularly limited, can be appropriately selected depending on the purpose, can be at least one selected from a black toner, a cyan toner, a magenta toner and a yellow toner, and the toner of each color can be obtained by appropriately selecting a type of the colorants.

The toner of the present invention combines the excellent cleaning ability, image quality and durability, can be suitably used in various fields, can be more suitably used for the image formation by electrographic methods, and can be particularly suitably used for the following vessel with toner, developer, process cartridge, image forming apparatus and image forming method.

(Developer)

The developer of the present invention contains at least the toner of the present invention, and contains other components such as carriers appropriately selected. The developer may be the one-component developer or the two component developer. When used for high speed printers corresponding to the enhancement of data processing speeds in recent years, the two-component developer is preferable in terms of enhanced lifetime.

In the case of the one-component developer using the toner of the present invention, even when the toner is consumed and supplied, the variation of the toner particle diameters is small, and there is no filming of the toner to the developing roller and no fusion-bond of the toner to the member such as blade for making the toner the thin layer. The good and stable developing property and image are obtained in the long term use (stirring) of the developing apparatus. In the case of the two-component developer using the toner of the present invention, even when the toner is consumed and supplied for a long time, the variation of the toner particle diameters during the development is small. The good and stable developing property is obtained in the long term stirring in the developing apparatus.

The carrier is not particularly limited, can be appropriately selected depending on the purpose, and those having a core material and a resin layer which covers the core material are preferable.

Materials for the core material are not particularly limited, can be appropriately selected from those known publicly, and for example, 50 emu/g to 90 emu/g of manganese-strontium (Mn—Sr) based materials and manganese-magnesium (Mn—Mg) based materials are preferable. In terms of assuring the image density, highly magnetized materials such as iron powder (100 emu/g or more) and magnetite (75 emu/g to 120 emu/g) are preferable. In terms of being advantageous for making the high image quality because contact to the photoconductor on which the toner stands like ears can be weakened, weakly magnetized materials such as copper-zinc ((Cu—Zn) based materials (30 emu/g to 80 emu/g) are also preferable. These may be used alone or in combination of two or more.

The particle diameter of the core material is preferably 10 μm to 150 μm and more preferably 40 μm to 100 μm as the volume average particle diameter.

When the average particle diameter (volume average particle diameter D50) is less than 10 μm, the fine powder is increased in the distribution of carrier particles, and magnetization per particle becomes low to sometimes cause carrier scattering. When it exceeds 150 μm, the specific surface area is reduced to sometimes cause carrier scattering. In the full color printing where solid portions are many, reproducibility of the solid portions is sometimes deteriorated.

Materials of the resin layer is not particularly limited, can be appropriately selected from publicly known resins depending on the purpose, and includes, for example, amino based resins, polyvinyl based resins, polystyrene based resins, halogenated olefin resins, polyester based resins, polycarbonate based resins, polyethylene resins, polyvinyl fluoride resins, polyvinylidene fluoride resins, polytrifluoroethylene resins, polyhexafluoropropylene resins, copolymers of vinylidene fluoride and acryl monomer, copolymers of vinylidene fluoride and vinyl fluoride, fluoro terpolymers such as terpolymers of tetrafluoroethylene and vinylidene fluoride and non-fluoride monomer and silicone resins. These may be used alone or in combination of two or more.

The amino based resins include, for example, urea-formaldehyde resins, melamine resins, benzoguanamine resins, urea resins, polyamide resins and epoxy resins. The polyvinyl based resins include, for example, acryl resins, polymethyl methacrylate resins, polyacrylonitrile resins, polyvinyl acetate resins, polyvinyl alcohol resins and polyvinyl butyral resins. The polystyrene based resins include, for example, polystyrene resins and styrene acryl copolymer resins. The halogenated olefin resins include, for example, polyvinyl chloride. The polyester based resins include, for example, polyethylene terephthalate resins and polybutylene terephthalate resins.

If necessary, conductive powders may be contained in the resin layer. The conductive powders include, for example, metal powders, carbon black, titanium oxide, tin oxide and zinc oxide. The average particle diameter of these conductive powders is preferably 1 μm or less. When the average particle diameter exceeds 1 μm, it sometimes becomes difficult to control electric resistance.

The resin layer can be formed by dissolving the silicone resin in the solvent to prepare a coating solution, uniformly applying the coating solution on the surface of the core material by a publicly known application method, and drying followed by baking. The application method includes, for example, a dipping method, a spray method and a blush coating method.

The solvent is not particularly limited, can be appropriately selected depending on the purpose, and includes, for example, toluene, xylene, methyl ethyl ketone, methyl isobutyl ketone, cellosolve and butyl acetate.

The baking is not particularly limited, may be an heating system or an internally heating system, and includes the methods using a fixed electric furnace, a fluidal electric furnace, a rotary electric furnace and a burner furnace, and the method using microwave.

The amount of the resin layer in the carrier is preferably 0.01% by mass and 5.0% by mass. When the amount is less than 0.01% by mass, no uniform resin layer can be sometimes formed on the surface of the core material. When it exceeds 5.0% by mass, the resin layer becomes too thick to cause the granulation of carrier particles one another, and no uniform carrier particles can be sometimes obtained.

When the developer is the two-component developer, the content of the carrier in the two-component developer is not particularly limited, can be appropriately selected depending on the purpose, and for example, is preferably 90% by mass to 98% by mass and more preferably 93% by mass to 97% by mass.

The developer of the present invention contains the toner, therefore, combines the excellent cleaning ability, image quality and durability, and can stably form the image with high quality.

The developer of the present invention can be suitably used for the image formation by publicly known various electrographic methods such as magnetic one-component developing methods, non-magnetic one-component developing methods and two-component developing methods, and particularly can be suitably used for the following vessel with toner, process cartridge, image forming apparatus and image forming method of the present invention.

(Vessel with Toner)

The vessel with toner of the present invention fills the toner or the developer of the present invention in the vessel.

The vessel is not particularly limited, can be appropriately selected from those known publicly, and suitably includes, for example, one having a vessel main body with the toner and a cap.

For the vessel main body with toner, its size, shape, structure and material are not particularly limited and can be appropriately selected depending on the purpose. For example, as the shape, a cylindrical one is preferable, and the vessel in which spiral asperity is formed on an inside periphery, the content can be moved to a discharging side by rotating and a part of or all of the spiral portion has an accordion function is particularly preferable.

The material of the vessel main body with the toner is not particularly limited, those having a good dimension accuracy are preferable, and for example the resin is suitably included. Among them, for example, polyester resins, polyethylene resins, polypropylene resins, polystyrene resins, polyvinyl chloride resins, polyacrylic acid, polycarbonate resins, ABS resins and polyacetal resins are suitably included.

The vessel with the toner of the present invention is easily stored and transported, is excellent in handling property, and can be suitably used for resupply of the toner by detachably attaching to the process cartridge and the image forming apparatus of the present invention described later.

(Process Cartridge)

The process cartridge of the present invention has at least a latent electrostatic image bearing member which bears a latent electrostatic image and a developing unit which develops the latent electrostatic image borne on the latent electrostatic image bearing member using the developer to form a visible image, and further has other units such as charging unit, exposing unit, developing unit, transferring unit, cleaning unit and electricity removing unit appropriately selected as needed.

The developing unit has at least a developer housing device which houses the toner or the developer of the present invention and a developer bearing member which bears and feeds the toner or the developer housed in the developer housing device, and further may have a layer thickness regulatory member for regulating a layer thickness of the toner to be borne.

The process cartridge of the present invention can be attached detachably to various electrographic apparatuses, and it is preferable to attach detachably to the image forming apparatus of the present invention described later.

Here, the process cartridge, for example, as shown in FIG. 1, builds-in the photoconductor 101, comprises a charge unit 102, a developing unit 104, a transferring unit 108 and a cleaning unit 107, and further has the other members if necessary. In FIG. 1, 103 represents the exposure by the exposing unit, and a light source capable of writing at high resolution is used. In FIG. 1, 105 represents the recording medium. As the photoconductor 101, the same one as in the image forming apparatus described later can be used. An optional charging member is used for the charging unit 102.

Subsequently, in the image formation process by the process cartridge shown in FIG. 1, as the photoconductor 101 rotates in an arrow direction, the latent electrostatic image corresponding to an exposure image is formed on its surface by charge by the charging unit 102 and the exposure 103 by the exposing unit (not shown in the figure). This latent electrostatic image is developed with the toner in the developing unit 104, the toner development is transferred onto the recording medium 105 by the transferring unit 108 and printed out. Subsequently, the photoconductor surface after the transfer of the image is cleaned by the cleaning unit 107, and its electricity is removed by the electricity removing unit (not shown in the figure). The above operation is repeated again.

(Image Forming Method and Image Forming Apparatus)

The image forming method of the present invention comprises at least a latent electrostatic image forming step, a developing step, a transferring step and a fixing step, preferably comprises a cleaning step, and further comprises other steps such as an electricity removing step, a recycling step and a controlling step appropriately selected as needed.

The image forming apparatus of the present invention has at least a latent electrostatic image bearing member, a latent electrostatic image forming unit, a developing unit, a transferring unit and a fixing unit, preferably has a cleaning unit, and further has other units such as an electricity removing unit, a recycling unit and a controlling unit appropriately selected as needed.

The image forming method of the present invention can be suitably carried out by the image forming apparatus of the present invention, the latent electrostatic image forming step can be performed by the latent electrostatic image forming unit, the developing step can be performed by the developing unit, the transferring step can be performed by the transferring unit, the fixing step can be performed by the fixing unit, and the other step can be performed by the other unit.

<Latent Electrostatic Image Forming Step and Latent Electrostatic Image Forming Unit>

The latent electrostatic image forming step is a step of forming the latent electrostatic image on the latent electrostatic image bearing member.

In the latent electrostatic image bearing member (sometimes referred to as a "light conductive insulator" or a "photoconductor"), its material, shape, structure and size are not particularly limited, and can be appropriately selected from those known publicly. Its shape suitably includes a drum shape, and its material includes inorganic photoconductors of amorphous silicon and serene and organic photoconductors of polysilane and phthalopolymethine. Among them, amorphous silicon is preferable in terms of long lifetime.

The latent electrostatic image can be formed, for example, by evenly charging the surface of the latent electrostatic image bearing member and subsequently exposing like the image, and can be formed by the latent electrostatic image forming unit. The latent electrostatic image forming unit comprises at least a charging device which evenly charges the surface of the latent electrostatic image bearing member and an exposing device which exposes the surface of the latent electrostatic image bearing member like the image.

The charge can be performed, for example using the charging device by applying voltage onto the surface of the latent electrostatic image bearing member.

The charging device is not particularly limited, can be appropriately selected depending on the purpose, and includes, for example, a publicly known contact charging device comprising a conductive or semi-conductive roll, brush, film or rubber blade, and a non-contact charging device utilizing corona discharge, e.g., corotron and scorotron.

The exposure can be performed by exposing the surface of the latent electrostatic image bearing member like the image using the exposing device.

The exposing device is not particularly limited as long as the exposure can be performed like the image to be formed on the surface of the latent electrostatic image bearing member charged by the charging device, can be appropriately selected depending on the purpose, and includes, for example, various exposing devices, e.g., a copy optical system, a rod lens eye system, a laser optical system and a liquid crystal shutter optical system. A light backside method of exposing from the backside of the image bearing member may be employed.

<Developing Step and Developing Unit>

The developing step is a step of forming the visible image by developing the latent electrostatic image using the toner or the developer of the present invention.

The visible image can be formed, for example, by developing the latent electrostatic image using the toner or the developer of the present invention, and can be formed by the developing unit.

The developing unit is not particularly limited as long as the development can be performed using the toner or the developer of the present invention, can be appropriately selected from those known publicly, and suitably includes those having a developing device which houses the developer of the present invention and can impart the toner or the developer to the latent electrostatic image in contact or in no contact with it. The developing device comprising the vessel with toner of the present invention is more preferable.

The developing device may employ a dry developing system or a wet developing system, or may be a monochromatic developing device or a multicolor developing device. For example, a stirring device which charges by frictionizing and stirring the toner or the developer and the one having a rotatable magnet roller are suitably included.

In the developing device, for example, the toner and the carrier are mixed and stirred, the toner is charged by friction at that time and kept in the ear-standing state on the surface of the rotating magnet roller to form a magnetic brush. The magnet roller is disposed in the vicinity of the latent electrostatic image bearing member (photoconductor). Thus, a part of the toner which composes the magnetic brush formed on the surface of the magnet roller migrates to the surface of the latent electrostatic image bearing member (photoconductor) by an electrically attracting force. As a result, the latent electrostatic image is developed by the toner and the visible image is formed on the surface of the latent electrostatic image bearing member (photoconductor).

The developer housed in the developing device is the developer comprising the toner of the present invention, and the developer may be the one-component developer or the two-component developer. The toner included in the developer is the toner of the present invention.

<Transferring Step and Transferring Unit>

The transferring step is a step of transferring the visible image onto a recording medium. It is preferable that using an intermediate transferring member, the visible image is primarily transferred onto the intermediate transferring member and subsequently the visible image is secondarily transferred onto the recording medium. As the toner, the toner having two or more colors and preferably full color toner is used. It is more preferable to have a primary transferring step in which the visible image is transferred onto the intermediate transferring member to form a composite transfer image and a secondary transferring step in which the composite transfer image is transferred onto the recording medium.

The transfer can be performed by transferring the visible image from the latent electrostatic image bearing member (photoconductor) using a transfer charging device, and can be performed by the transferring unit. It is preferable that the transferring unit has a primary transferring unit in which the visible image is transferred onto the intermediate transferring member to form the composite transfer image and a secondary transferring unit in which the composite transfer image is transferred onto the recording medium.

The intermediate transferring member is not particularly limited, can be appropriately selected from those known publicly depending on the purpose, and suitably includes, for example, a transfer belt.

It is preferable that the transferring unit (the primary transferring unit, the secondary transferring unit) has a transferring device which peels and charges the visible image formed on the latent electrostatic image bearing member (photoconductor) to the side of the recording medium. There may be one transferring unit or multiple transferring units. The transferring device includes a corona transferring device by corona discharge, the transfer belt, a transfer roller, a pressure transfer roller and an adhesion transferring device. The recording medium is not particularly limited, and can be appropriately selected from the recording media (recording papers) known publicly.

<Fixing Step and Fixing Unit>

The fixing step is a step of fixing the visible image transferred onto the recording medium using the fixing unit. Each color toner may be fixed every transfer onto the recording medium, or respective toners may be laminated and then fixed all at once.

The fixing unit is not particularly limited, can be appropriately selected depending on the purpose, and heating pressurizing units known publicly are suitable. The heating pressurizing units include the combination of a heating roller and a pressurizing roller and the combination of the heating roller, the pressurizing roller and an endless belt.

The heating in the heating pressurizing unit is preferably to be at 80° C. to 200° C. typically.

In the present invention, depending on the purpose, together with or in place of the fixing step and the fixing unit, a light fixing device known publicly may be used.

The electricity removing step is a step of removing the electricity by applying an electricity removing bias to the latent electrostatic image bearing member, and can be suitably performed by the electricity removing unit.

The electricity removing unit is not particularly limited, could apply the electricity removing bias to the latent electrostatic image bearing member, can be appropriately selected from electricity removing devices known publicly, and includes, for example, an electricity removing lamp.

The cleaning step is a step of removing the toner for electrographs left on the latent electrostatic image bearing member, and can be suitably performed using the cleaning unit. The cleaning unit is not particularly limited, could remove the toner for electrographs left on the latent electrostatic image bearing member, can be appropriately selected from publicly known cleaners, and suitably includes, for example, a magnetic brush cleaner, an electrostatic brush cleaner, a magnetic roller cleaner, a blade cleaner, a brush cleaner and a web cleaner.

The recycling step is a step of recycling the toner removed in the cleaning step in the developing unit, and can be suitably performed using the recycling unit.

The recycling unit is not particularly limited, and includes publicly known feeding units.

The controlling step is a step of controlling respective steps, and can be suitably performed using the controlling unit.

The controlling unit is not particularly limited as long as it can control the operation of each unit, can be appropriately selected depending on the purpose, and includes, for example, equipments such as sequencers and computers.

One aspect of performing the image forming method of the present invention by the image forming apparatus of the present invention will be described with reference to FIG. 2. The image forming apparatus 100 shown in FIG. 2 comprises a photoconductor drum 10 (hereinafter sometimes referred to as the "photoconductor 10") as the latent electrostatic image bearing member, a charging roller 20 as the charging unit, an exposing apparatus 30 as the exposing unit, a developing apparatus 40 as the developing unit, an intermediate transferring member 50, a cleaning apparatus 60 as the cleaning unit having a cleaning blade, and an electricity removing lamp 70 as the electricity removing unit.

The intermediate transferring member 50 is an endless belt, and is tightly stretched with three rollers 51 so as to move in an arrow direction. A part of three roller 51 also functions as a transfer bias roller which can apply a given transfer bias (primary transfer bias) to the intermediate transferring member 50. The cleaning apparatus 90 having the cleaning blade is disposed in the vicinity of the intermediate transferring member 50. A transferring roller 80 is oppositely disposed as the transferring unit which can apply the transfer bias to transfer (secondary transfer) a developed image (toner image) onto a transfer paper 95 as a final transfer material. In a surrounding area of the intermediate transferring member 50, the corona charging device 58 for imparting the charge to the toner image on the intermediate transferring member 50 is disposed in a rotation direction of the intermediate transferring member 50, between a contact section of the photoconductor 10 with the intermediate transferring member 50 and a contact section of the intermediate transferring member 50 with a transfer paper 95.

The developing apparatus is composed of a developing belt 41 as the developer bearing member and a black developing unit 45K, a yellow developing unit 45Y, a magenta developing unit 45M and a cyan developing unit 45C arranged together around the developing belt 41. The black developing unit 45K comprises a developer housing section 42K, a developer supplying roller 43K and a developing roller 44K, the yellow developing unit 45Y comprises a developer housing section 42Y, a developer supplying roller 43Y and a developing roller 44Y, the magenta developing unit 45M comprises a developer housing section 42M, a developer supplying roller 43M and a developing roller 44M, and the cyan developing unit 45C comprises a developer housing section 42C, a developer supplying roller 43C and a developing roller 44C. The developing belt 41 is the endless belt and tightly stretched with multiple belt rollers rotatably, and a part thereof is contacted with the photoconductor 10.

Figure 2:
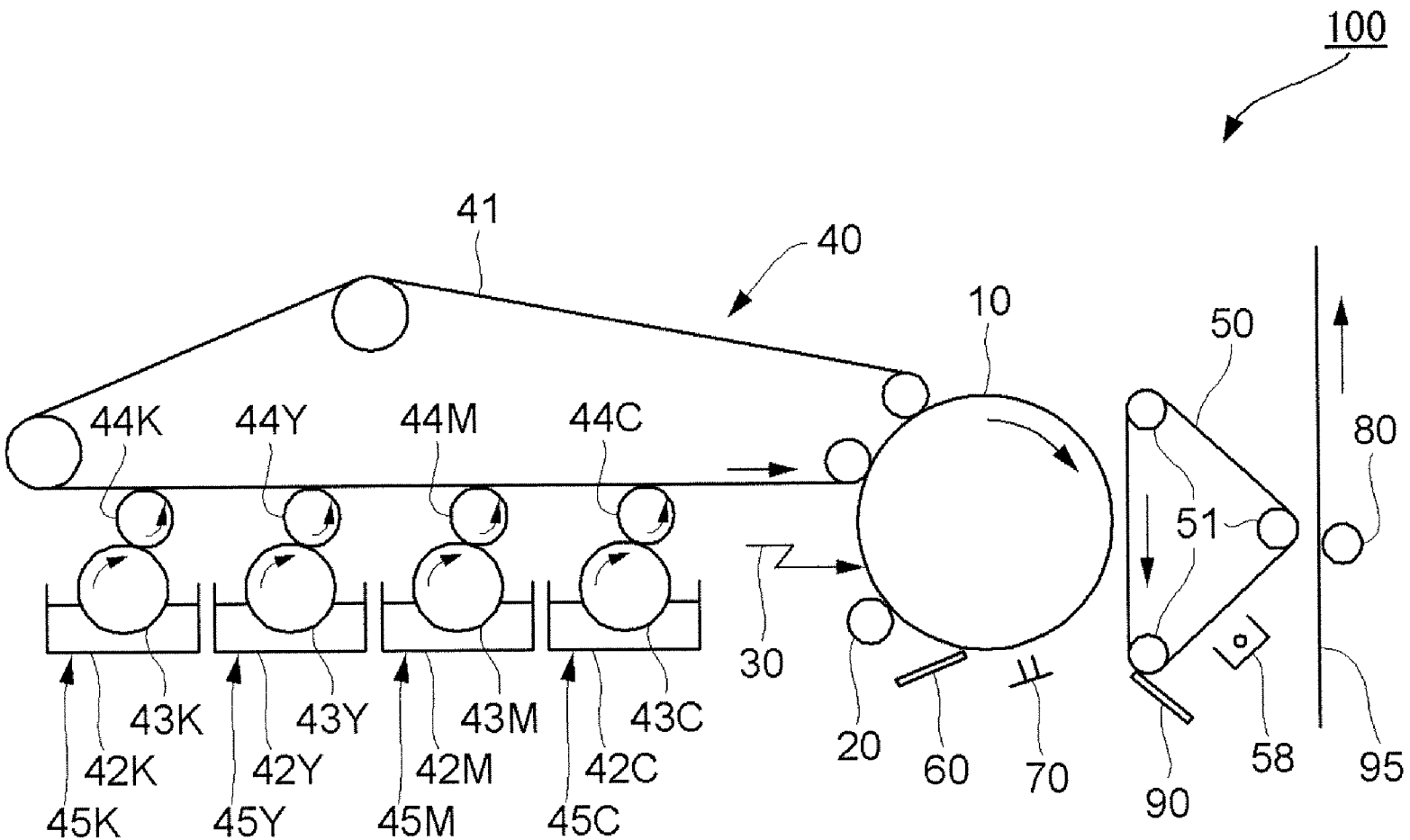
FIG. 2 is a schematic illustrative view showing one example of carrying out the image forming method of the present invention by the image forming apparatus of the present invention.

In the image forming apparatus 100 shown in FIG. 2, for example, the charging roller 20 charges the photoconductor 10 evenly. The photoconductor 10 is exposed using the exposing apparatus 30 to form the latent electrostatic image. The latent electrostatic image formed on the photoconductor drum 10 is developed by supplying the toner from the developing apparatus 40 to form the visible image (toner image). The toner image is transferred onto the intermediate transferring member 50 (primary transfer) by voltage applied from the roller 51, and further transferred onto the transfer paper 95 (secondary transfer). As a result, the transfer image is formed on the transfer paper 95. The toner left on the photoconductor 10 is removed by the cleaning apparatus 60, and the charge on the photoconductor 10 is once removed by the electricity removing lamp 70.

Figure 3:
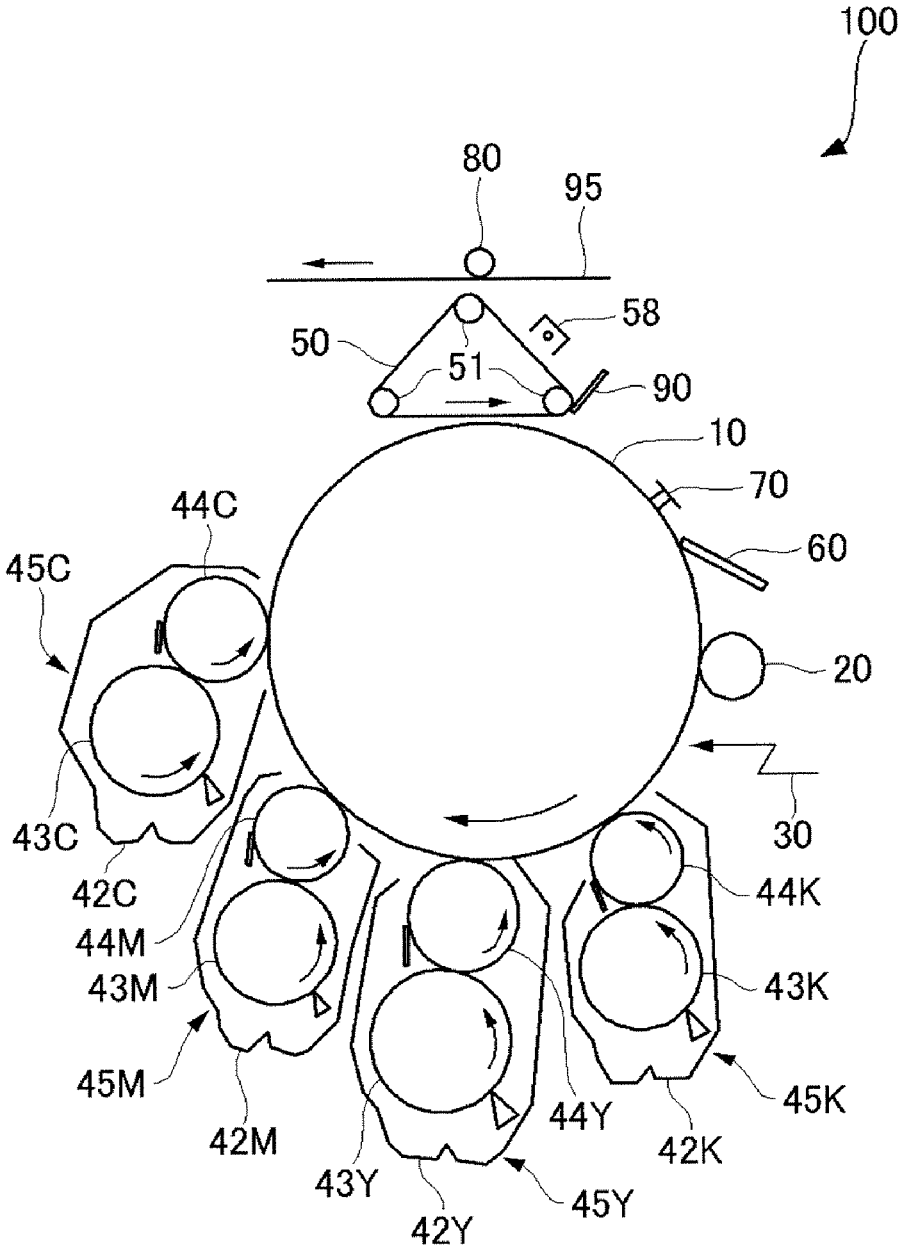
FIG. 3 is a schematic illustrative view showing another example of carrying out the image forming method of the present invention by the image forming apparatus of the present invention.

Another aspect of performing the image forming method of the present invention by the image forming apparatus of the present invention will be described with reference to FIG. 3. The image forming apparatus 100 shown in FIG. 3 has the same constitution and exhibits the same action effects as in the image forming apparatus 100 shown in FIG. 2, except for comprising no developing belt 41 and directly oppositely disposing the black developing unit 45K, the yellow developing unit 45Y, the magenta developing unit 45M and the cyan developing unit 45C around the photoconductor 10. In FIG. 3, those which were the same as in FIG. 2 were represented by the same signs.

Figure 4:
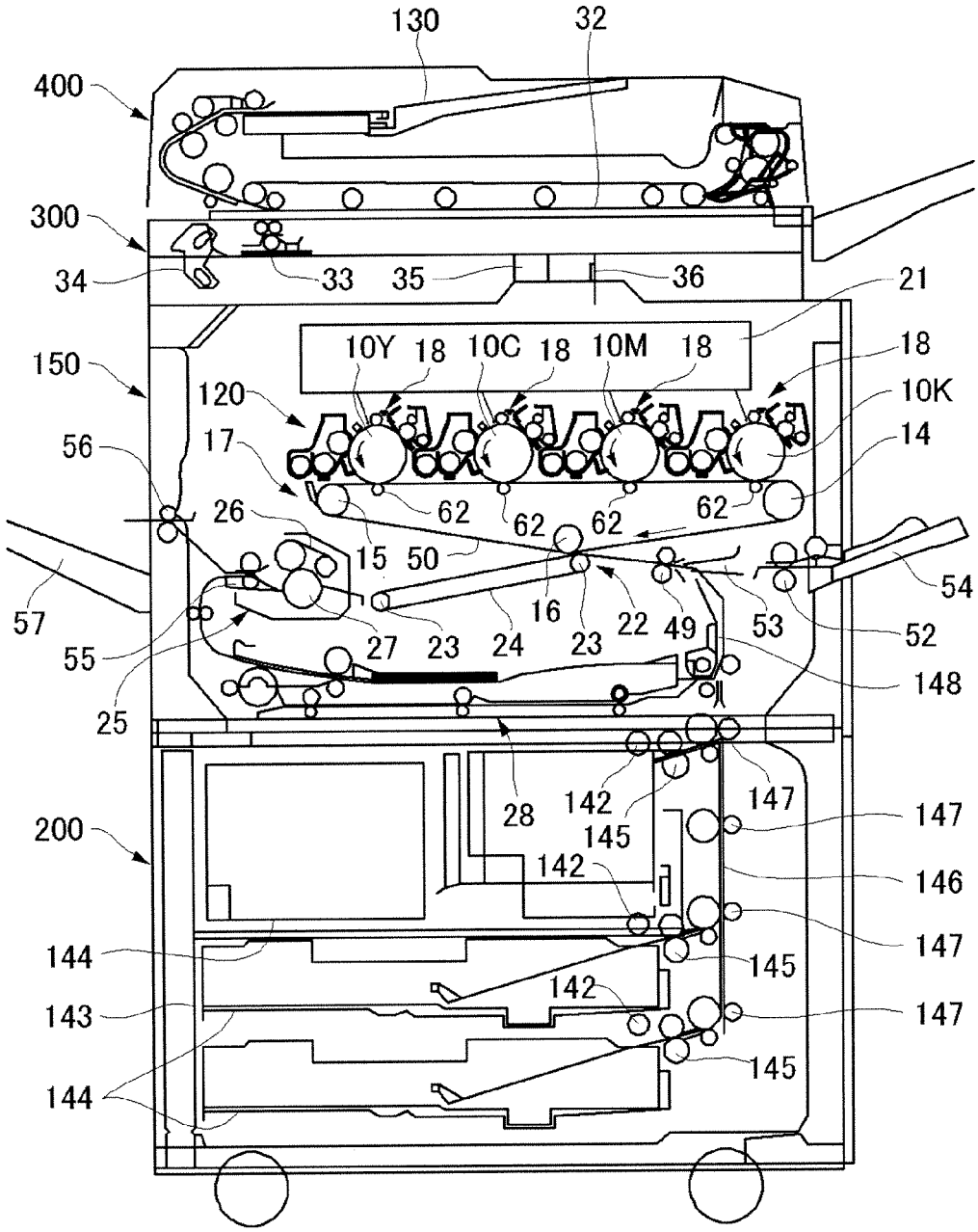
FIG. 4 is a schematic illustrative view showing one example of carrying out the image forming method of the present invention by the image forming apparatus (tandem type color image forming apparatus) of the present invention.

Another aspect of performing the image forming method of the present invention by the image forming apparatus of the present invention will be described with reference to FIG. 4. A tandem type image forming apparatus 100 shown in FIG. 4 is a tandem type color image forming apparatus. The tandem type image forming apparatus 100 comprises a copy apparatus main body 150, a paper supply table 200, a scanner 300 and an automatically draft feeding (ADF) apparatus 400. In the copy apparatus main body 150, the endless belt-shaped intermediate transferring member 50 is provided in a central section. And, the intermediate transferring member 50 is tightly stretched with support rollers 14, 15 and 16 and is rotatable clockwise in FIG. 4. An intermediate transferring member cleaning apparatus 17 to remove the toner left on the intermediate transferring member 50 is disposed in the vicinity of the support roller 15. A tandem type developing device 120 in which 4 color image forming units 18 of yellow, cyan, magenta and black have been oppositely arranged together is disposed to the intermediate transferring member 50 tightly stretched with the support rollers 14 and 15, along a feeding direction thereof. In the vicinity of the tandem type developing device 120, the exposing apparatus 21 is disposed. A secondary transferring apparatus 22 is disposed at the side of the intermediate transferring member opposite to the side at which the tandem type developing device 120 is disposed. In the secondary transferring apparatus 22, a secondary transfer belt 24 which is the endless belt is tightly stretched with a pair of rollers 23, and the transfer paper fed on the secondary transfer belt 24 can be mutually contacted with the intermediate transferring member 50. In the vicinity of the secondary transferring apparatus 22, the fixing apparatus 25 is disposed. The fixing apparatus 25 comprises a fixing belt 26 which is the endless belt and a pressurizing roller 27 disposed by press-pushing to the fixing belt 26.

In the tandem type image forming apparatus 100, in the vicinity of the secondary transferring apparatus 22 and the fixing apparatus 25, a sheet reversal apparatus 28 which reverses the transfer paper to form the images on both sides on the transfer paper is disposed.

Subsequently, the formation of the full color image (color copy) using the tandem type developing device will be described. First, a draft is set on a draft table 130 of the automatically draft feeding apparatus 400, or alternatively the automatically draft feeding apparatus 400 is opened, the draft is set on a contact glass 32 of the scanner 300 and the automatically draft feeding apparatus 400 is closed.

When a start switch (not shown in the figure) is pushed, after feeding the draft onto the contact glass 32 when the draft has been set in the automatically draft feeding apparatus 400, or immediately when the draft has been set on the contact glass 32, the scanner is driven, and a first carriage 33 and a second carriage 34 runs. At that time, the light from the light source is irradiated as well as the reflection light from a draft side irradiated from the first carriage is reflected at a mirror in the second carriage 34, and received by a reading sensor 36 through an imaging lens 35. By this operation, a color draft (color image) is read out to generate an image information of respective colors such as black, yellow, magenta and cyan.

Figure 5:
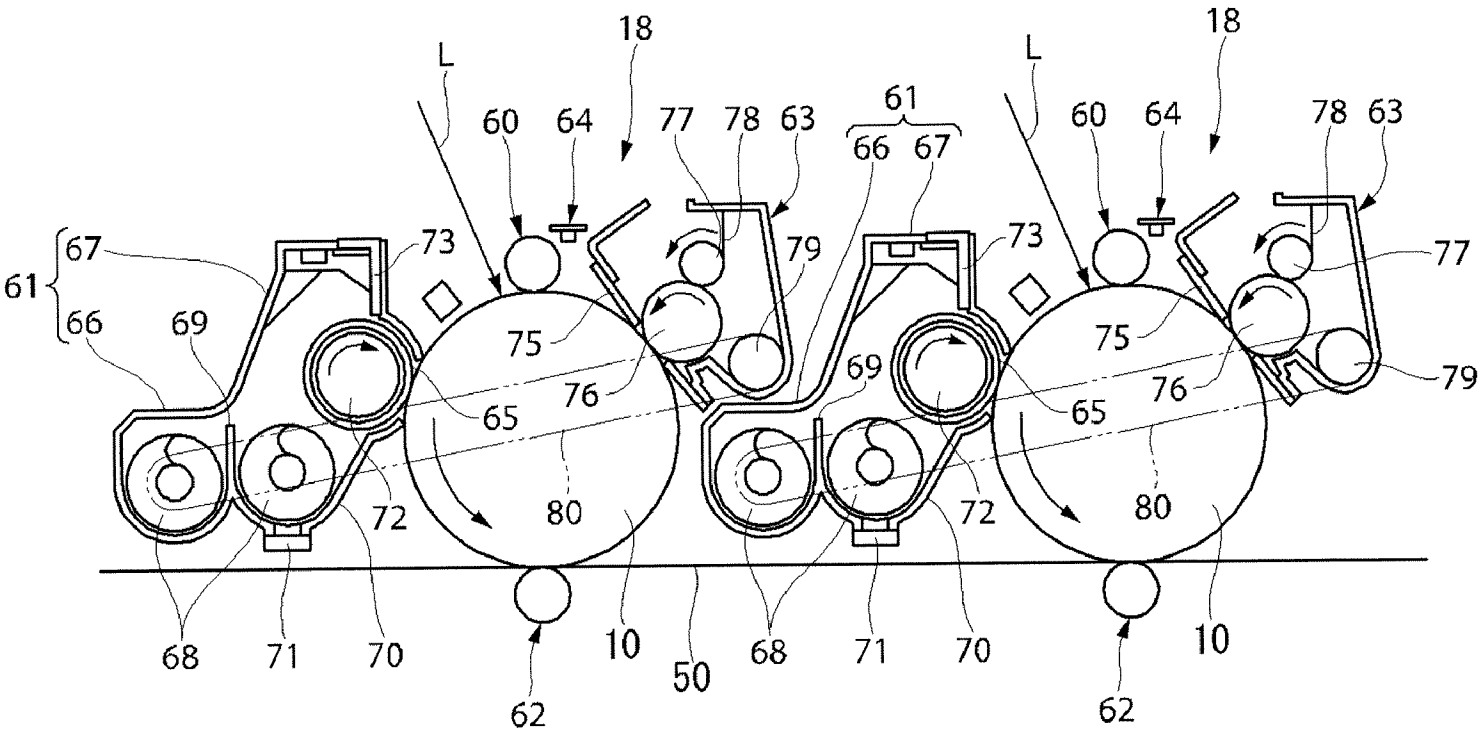
FIG. 5 is a partially magnified schematic view of the image forming apparatus shown in FIG. 4.
Figure 6:
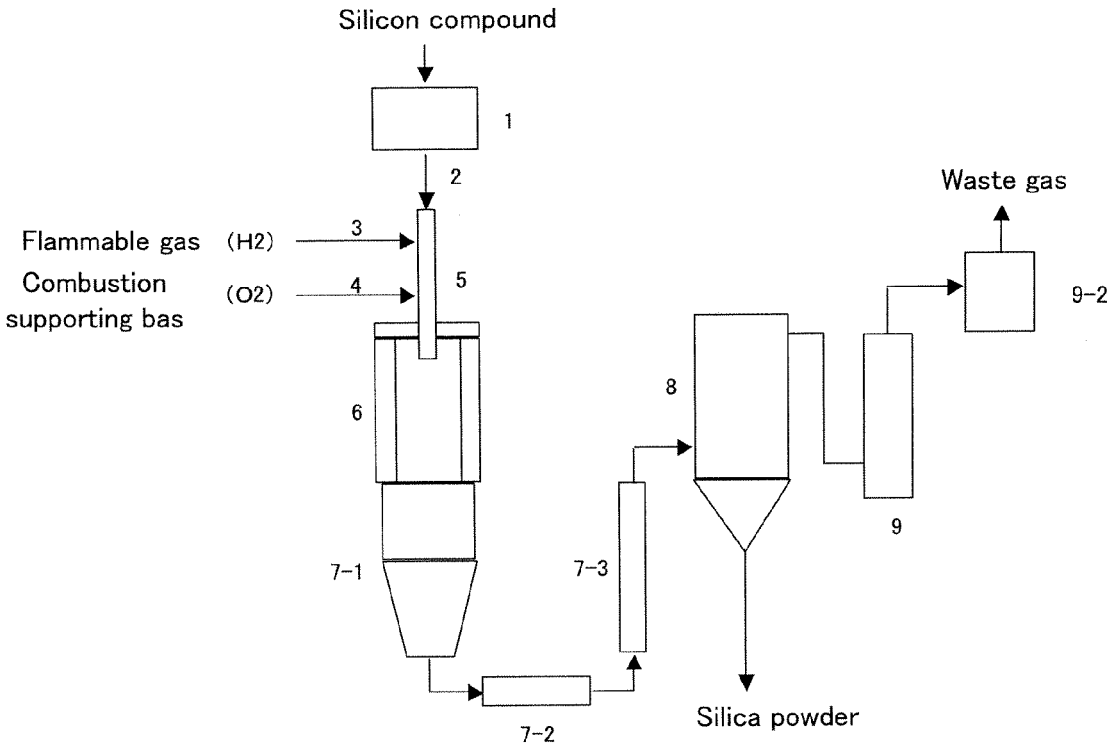
FIG. 6 is a schematic illustrative view showing one example of preparing dry system non-spherical silica.

Image information of black, yellow, magenta and cyan is transmitted to respective image forming units 18 (image forming unit for black, image forming unit for yellow, image forming unit for magenta and image forming unit for cyan) in the tandem type developing device 120 to form the respective toner images of black, yellow, magenta and cyan in each image forming unit. That is, each image forming unit 18 (image forming unit for black, image forming unit for yellow, image forming unit for magenta and image forming unit for cyan) in the tandem type developing device 120 comprises the photoconductor 10 (photoconductor for black 10K, photoconductor for yellow 10Y, photoconductor for magenta 10M and photoconductor for cyan 10C), a charging device 60 which evenly charges the photoconductor, an exposing device which exposes (L in FIG. 5) the photoconductor based on each color image information and forms the latent electrostatic image corresponding to each color image on the photoconductor, a developing device 61 which develops the latent electrostatic image using each color toner (black toner, yellow toner, magenta toner and cyan toner) to form the toner image by each color toner, a transfer charging device 62 for transferring the toner image onto the intermediate transferring member 50, a photoconductor cleaning apparatus 63 and an electricity removing device 64, and can form the image with each single color (black image, yellow image, magenta image and cyan image) based on each color image information. The black image, the yellow image, the magenta image and the cyan image formed in this way as the black image formed on the photoconductor for black 10K, the yellow image formed on the photoconductor for yellow 10Y, the magenta image formed on the photoconductor for magenta 10M and the cyan image formed on the photoconductor for cyan 10C are sequentially transferred (primary transfer) onto the intermediate transferring member 50 rotated and moved by the support rollers 14, 15 and 16. A composite color image (color transfer image) is formed by laminating the black image, the yellow image, the magenta image and the cyan image on the intermediate transferring member 50.

Meanwhile, in the paper supply table 200, one of paper supply roller 142 is selectively rotated, a sheet (recording paper) is turned out from one of paper supply cassettes 144 provided in multiple stages in a paper bank 143, separated one by one by a separation roller 145 to send out to a paper supply path 146, fed by a feeding roller 147 to lead a paper supply path 148 in the copy machine main body 150, and stopped by hitting against a resist roller 49. Alternatively, the sheet (recording paper) on a manual paper feeding tray is turned out by rotating a paper supply roller 142, separated one by one to place a manual paper feeding paper supply path 53, and similarly stopped by hitting against the resist roller 49. The resist roller 49 is generally used by connecting to ground, but may be used by applying bias for removing paper powders of the sheet.

And, a color image is transferred and formed on the sheet (recording paper) by rotating the resist roller 49 in timing with a composite color image (color transfer image) combined on the intermediate transferring member 50, sending out the sheet (recording paper) between the intermediate transferring member 50 and the secondary transferring apparatus 22, and transferring (secondary transfer) the composite color image (color transfer image) on the sheet (recording paper). The toner left on the intermediate transferring member 50 after the transfer is cleaned by the intermediate transferring member cleaning apparatus 17.

The sheet (recording paper) on which the color image has been transferred and formed is fed to the fixing apparatus 25 by the secondary transferring apparatus 22, and the composite color image (color transfer image) is fixed on the sheet (recording paper) with heat and pressure. Subsequently, the sheet (recording paper) is switched at a switch blade 55 to discharge by a discharging roller 56, and stacked on a paper discharge tray 57. Alternatively, the sheet is switched at the switch blade 55, reversed by the reversing apparatus 28 to lead again to the transfer position, and the image is recorded on a backside, then the sheet is discharged by the discharging roller 56 and stacked on the paper discharge tray 57.

In the image forming apparatus and the image forming method of the present invention, the toner of the present invention which combines the excellent cleaning ability, image quality and durability is used. Thus, the high image quality is efficiently obtained.

EXAMPLES

Examples of the present invention will be described below, but the present invention is not limited to the following Examples at all.

Example 1

Preparation of Toner Base Particles

Synthesis of Organic Fine Particle Emulsion

In a reaction vessel equipped with a stirring bar and a thermometer, 683 parts by mass of water, 11 parts by mass of sodium salt of methacrylic acid ethylene oxide adduct sulfate ester (Eleminol RS-30 supplied from Sanyo Chemical Industries, Ltd.), 83 parts by mass of styrene, 83 parts by mass of methacrylic acid, 110 parts by mass of butyl acrylate and 1 part by mass of ammonium persulfate were added, the mixture was stirred at 400 rpm for 15 minutes, and consequently a white liquid emulsion was yielded. The temperature in a reaction system was raised up to 75° C. by heating, and the reaction was performed for 5 hours. Then, 30 parts by mass of an aqueous solution of 1% by mass ammonium persulfate was added, and the reaction was matured at 75° C. for 5 hours to yield an aqueous dispersion of vinyl based resin (copolymer of sodium salt of styrene-methacrylic acid-butyl acrylate-methacrylic acid ethylene oxide adduct sulfate ester) [fine particle dispersion 1].

The resulting [fine particle dispersion 1] was measured by a particle diameter distribution measurement apparatus (LA-920 supplied from Horiba) using a laser light scattering method. As a result, the mass average particle diameter was 105 nm. A part of the [fine particle dispersion 1] was dried to isolate a resin component. The glass transition temperature (Tg) of the resin component was 59° C. and the mass average molecular weight (Mw) was 150,000.

Preparation of Water Phase

Water (990 parts by mass), 83 parts by mass of [fine particle dispersion 1], 37 parts by mass of an aqueous solution of 48.5% by mass dodecyldiphenyl ether sodium disulfonate (Eleminol MON-7 supplied from Sanyo Chemical Industries, Ltd.), and 90 parts by mass of ethyl acetate were mixed and stirred to yield a liquid with milk white. This is rendered a [water phase 1].

Synthesis of Low Molecular Polyester

In a reaction vessel equipped with a cooling tube, a stirrer and a nitrogen introducing tube, 229 parts by mass of bisphenol A ethylene oxide 2 mol adduct, 529 parts by mass of bisphenol A propyl oxide 3 mol adduct, 208 parts by mass of terephthalic acid, 46 parts by mass of adipic acid and 2 parts by mass of dibutyl tin oxide were added, and reacted under atmospheric pressure at 230° C. for 8 hours. Then, the reaction was performed under reduced pressure of 10 mmHg to 15 mmHg for 5 hours, subsequently 44 parts by mass of trimellitic acid anhydrate was added into the reaction vessel, and the reaction was continued at 180° C. at atmospheric pressure for 2 hours to yield a [low molecular polyester 1].

The resulting [low molecular polyester 1] had the number average molecular weight (Mn) of 2,500, the mass average molecular weight (Mw) of 6,700, the glass transition temperature (Tg) of 43° C. and the acid value of 25 mg KOH/g.

Synthesis of Intermediate Polyester and Prepolymer

In a reaction vessel equipped with a cooling tube, a stirrer and a nitrogen introducing tube, 682 parts by mass of bisphenol A ethylene oxide 2 mol adduct, 81 parts by mass of bisphenol A propyl oxide 2 mol adduct, 283 parts by mass of terephthalic acid, 22 parts by mass of trimellitic acid anhydrate and 2 parts by mass of dibutyl tin oxide were added, and reacted under atmospheric pressure at 230° C. for 8 hours. Then, the reaction was performed under reduced pressure of 10 mmHg to 15 mmHg for 5 hours to synthesize an [intermediate polyester 1].

The resulting [intermediate polyester 1] had the number average molecular weight (Mn) of 2,100, the mass average molecular weight (Mw) of 9,500, the glass transition temperature (Tg) of 55° C., the acid value of 0.5 mg KOH/g and the hydroxyl group value of 51.

Subsequently, in a reaction vessel equipped with a cooling tube, a stirrer and a nitrogen introducing tube, 410 parts by mass of the [intermediate polyester 1], 89 parts by mass of isophorone diisocyanate and 500 parts by mass of ethyl acetate were placed, and reacted at 100° C. for 5 hours to synthesize a [prepolymer 1]. The content of free isocyanate in the resulting prepolymer was 1.53% by mass.

Synthesis of Ketimine

In a reaction vessel equipped with a stirring bar and a thermometer, 170 parts by mass of isophorone diamine and 75 parts by mass of methyl ethyl ketone were placed, and reacted at 50° C. for 5 hours to synthesize a [ketimine compound I]. An amine value in the resulting [ketimine compound I] was 418.

Synthesis of Master Batch

Water (35 parts by mass), 40 parts by mass of phthalocyanine pigment (FG7351 supplied from Toyo Ink Mfg. Co., Ltd.) and 60 parts by mass of polyester resin (RS801 supplied from Sanyo Chemical Industries, Ltd.) were mixed using Henschel mixer (supplied from Mitsui Mining Co., Ltd.), the resulting mixture was kneaded at 150° C. for 30 minutes using two rolls, subsequently extended with pressure and cooled, and then pulverized by a pulverizer to yield a [master batch 1].

Preparation of Oil Phase

In a reaction vessel equipped with a stirring bar and a thermometer, 378 parts by mass of the [low molecular polyester 1], 110 parts by mass of carnauba wax, 22 parts by mass of a charge controlling agent (CCA, salicylate metal complex E-84 supplied from Orient Chemical Industries Ltd.) and 947 parts by mass of ethyl acetate were placed, the temperature was raised up to 80° C. under stirring, the temperature at 80° C. was kept for 5 hours, and cooled to 30° C. in one hour. Then, 500 parts by mass of the [master batch 1] and 500 parts by mass of ethyl acetate were placed in the vessel, and mixed for one hour to yield a [raw material solution 1].

The resulting [raw material solution 1] (1324 parts by mass) was transferred to another vessel, and using a bead mill (Ultraviscomill supplied from Imex), carbon black and wax were dispersed under conditions of a liquid sending speed of 1 kg/hr, a disc peripheral speed of 6 m/second, 80% by volume filled with 0.5 mm zirconium beads and 3 passes. Subsequently, 1324 parts by mass of a solution of 65% by mass [low molecular polyester 1] in ethyl acetate was added, and one pass was performed under the above condition to yield a [pigment and wax dispersion 1]. A solid content concentration (130° C., 30 minutes) of the resulting [pigment and wax dispersion 1] was 50% by mass.

Emulsification

In a vessel, 648 parts by mass of the [pigment and wax dispersion 1], 154 parts by mass of the [prepolymer 1] and 6.6 parts by mass of the [ketimine compound 1] were placed, mixed at 5,000 rpm for one minutes using T.K. Homomixer (supplied from Tokushu Kika Kogyo Co., Ltd.), subsequently 1200 parts of the [water phase 1] was added to the vessel, the mixture was mixed at 13,000 rpm for 20 minutes using T.K. Homomixer to yield an [emulsified slurry 1].

Preparation of Shape Controlled Slurry

Serogen BS-H (0.75 parts by mass) (supplied from Dauichi Kogyo Seiyaku Co., Ltd.) is added in small portions to 18 parts by mass of ion exchange water stirred at 2,000 rpm using T.K. Homomixer (supplied from Tokushu Kika Kogyo Co., Ltd.). After the addition, the mixture is stirred for 30 minutes with keeping at 20° C. To the resulting Serogen solution, 725 parts by mass of ion exchange water, 58 parts by mass of the [fine particle dispersion 1], 147 parts by mass of the aqueous solution of 48.5% by mass dodecyldiphenyl ether sodium disulfonate (Eleminol MON-7 supplied from Sanyo Chemical Industries, Ltd.), and 90 parts by mass of ethyl acetate were mixed and stirred to yield a liquid with milk white. This is rendered a [water phase 1].

Subsequently, Serogen BS-H (3.15 parts by mass) (supplied from Daiichi Kogyo Seiyaku Co., Ltd.) is added in small portions to 75.6 parts by mass of ion exchange water stirred at 2,000 rpm using T.K. Homomixer (supplied from Tokushu Kika Kogyo Co., Ltd.). After the addition, the mixture is stirred for 30 minutes with keeping at 20° C. To the resulting Serogen solution, 43.3 parts by mass of the aqueous solution of 48.5% by mass dodecyldiphenyl ether sodium disulfonate (Eleminol MON-7 supplied from Sanyo Chemical Industries, Ltd.) is added. After the addition, the mixture is stirred for 5 minutes with keeping at 20° C. Into this, 2000 parts by mass of the [emulsified slurry 1] was added, and the mixture was mixed at 2,000 rpm for one hour using T.K. Homomixer to yield a [shape controlled slurry 1].

Desolvent in a vessel equipped with a stirrer and a thermometer, the [shape controlled slurry 1] was placed, desolvent was performed at 30° C. for 8 hours, and maturation was performed at 45° C. for 4 hours to yield a [dispersion slurry 1].

Washing and Drying

The [dispersion slurry 1] (100 parts by mass) was filtrated under reduced pressure, and subsequently washed and dried as follows.

(1) Ion exchange water (100 parts by mass) was added to a filtration cake, which was then mixed using T.K. Homomixer (12,000 rpm for 10 minutes) and subsequently filtrated.

(2) An aqueous solution (100 parts by mass) of 10% by mass sodium hydroxide was added to the filtration cake of (1), which was then mixed using T.K. Homomixer (12,000 rpm for 10 minutes) and subsequently filtrated under reduced pressure.

(3) 10% By mass hydrochloric acid (100 parts by mass) was added to the filtration cake of (2), which was then mixed using T.K. Homomixer (12,000 rpm for 10 minutes) and subsequently filtrated.

(4) Ion exchange water (300 parts by mass) was added to the filtration cake of (3), which was then mixed using T.K. Homomixer (12,000 rpm for 10 minutes) and subsequently filtrated. The manipulation of (4) was repeated to yield the [filtration cake 1].

The resulting filtration cake was dried using a fair wind dryer at 45° C. for 48 hours and sieved using a mesh with openings of 75 μm to yield a final [toner base particle A].

The resulting [toner base particle A] had the volume average particle diameter of 5.8 μm and the average circularity of 0.966.

External Additive

The external additive of any of the following (A) to (K) was used in the following Examples and Comparative Examples. Various physical properties of the external additive were measured as follows.

<Measurement of Mass Reduction Rate when Heated from 30° C. to 250° C.>

A percentage of the mass reduction of the external additive was measured using DTA-Tg measurement apparatus (DTG-60 supplied from Shimadzu Corporation) when heated from 30° C. to 250° C.

<Measurement of BET Specific Surface Area>

The BET specific surface area was calculated using a specific surface area measurement apparatus ("Autosoap 1" supplied from Yuasa Ionics) by absorbing nitrogen gas to the sample surface using a BET multiple point method.

<Measurement of True Specific Gravity>

A volume of a sample is calculated using AccuPyc 1330 supplied from Shimadzu Corporation using a gas phase substitution method by changing the volume and a pressure of the gas at a certain temperature. He gas is used as the gas, and the volume of the sample is obtained by changing the volume and the pressure. A density of the sample was obtained by measuring the volume and subsequently measuring the mass.

<Measurement of Shape and Major Axis of Silica Particle>

The shape of the silica particle can be analyzed by randomly sampling 300 SEM images of a silica particle single body obtained by measuring using FE-SEM (S-4200) supplied from Hitachi Ltd., and introducing their image information into an image analyzer (Luzex AP supplied from Nicole) through an interface.

<Preparation of Dry System Non-Spherical Silica>

Non-crystalline fine silica particles were produced as follows using a production apparatus composed of an evaporating device 1 for supplying a silicon compound as the raw material by vaporizing, a supply pipe 2 for supplying a silicon compound gas as the raw material, a supply pipe 3 for supplying a flammable gas, a supply pipe 4 for supplying a combustion supporting gas, a burner 5 connected to these supply pipes 2 to 4, a reactor 6 (perform a flame hydrolysis), a cooling pipe 7 linked to a downstream side of the reactor 6, a collecting apparatus 8 which collects produced silica powders, a waste gas treating apparatus 9 positioned further downstream and an exhaust fan 9-2.

In the production process, the supply pipe of the combustion supporting gas is opened to supply an oxygen gas to the burner, the burner for ignition is ignited, subsequently the supply pipe of the flammable gas is opened to supply a hydrogen gas and form the flame, silicon tetrachloride is gasificated in the evaporating device 1 and supplied thereto to perform the flame hydrolysis, and the produced silica powder is collected by a bag filter in the collecting apparatus 8. A waste gas after collecting the powder was treated in the waste gas treating apparatus 9, and discharged through the exhaust fan 9-2. The amount of silicon tetrachloride gas which is the raw material, the amounts of the oxygen gas and the hydrogen gas, a silica concentration and a retention time in the flame, the true specific gravity of the produced silica particles, the major axis D50, the shape and the BET specific surface area are shown in Table 1.

TABLE 1

| | Dry system non-spherical silica | | | |
|---|---|---|---|---|
| | A | B | C | D |
| Silicon tetrachloride (kg/hr) | 80.0 | 100.0 | 120.0 | 80.0 |
| Hydrogen gas ($Nm^3$/hr) | 40.0 | 50.0 | 60.0 | 40.0 |
| Oxygen gas ($Nm^3$/hr) | 20.0 | 30.0 | 30.0 | 20.0 |
| Silica concentration (kg/$Nm^3$) | 0.51 | 0.52 | 0.6 | 0.43 |
| Retention time (sec) | 0.35 | 0.38 | 0.38 | 0.32 |
| True specific gravity (g/$cm^3$) | 2.1 | 2.1 | 2.08 | 2.2 |
| Major axis D50 (nm) | 120 | 150 | 175 | 90 |
| Shape | Beadroll | Tetrapod | Tetrapod | Beadroll |
| BET specific surface area ($m^2$/g) | 24.0 | 18.0 | 16.0 | 35.0 |

<Surface Treatment and Various Physical Properties of Dry System Non-Spherical Silica>

Dry system non-spherical silica (A): The hydrophobilization treatment with hexamethyldisilazane (HMDS) (hydrophobilization degree: 65) was given to non-spherical fumed silica obtained by the dry system to yield the dry system non-spherical silica (A) having the true specific gravity of 2.1 and the major axis D50 of 120 nm (standard deviation of 22 nm). The BET specific surface area was 24.0($m^2$/g). The mass reduction rate when heated from 30° C. to 250° C. was 0.55% by mass.

Dry system non-spherical silica (B): The hydrophobilization treatment with hexamethyldisilazane (HMDS) was given to non-spherical fumed silica obtained by the dry system to yield the dry system non-spherical silica (B) having the true specific gravity of 2.1 and the major axis D50 of 150 nm (standard deviation of 36 nm).

Dry system non-spherical silica (C): The hydrophobilization treatment with hexamethyldisilazane (HMDS) was given to non-spherical fumed silica obtained by the dry system to yield the dry system non-spherical silica (C) having the true specific gravity of 2.1 and the major axis D50 of 175 nm (standard deviation of 39 nm).

Dry system non-spherical silica (D): The hydrophobilization treatment with hexamethyldisilazane (HMDS) was given to non-spherical fumed silica obtained by the dry system to yield the dry system non-spherical silica (D) having the true specific gravity of 2.2 and the major axis D50 of 90 nm (standard deviation of 23 nm).

Monodispersion spherical silica (E): The treatment with hexamethyldisilazane (HMDS) was given to silica sol obtained by a sol gel method to yield the monodispersion spherical silica (E) having the true specific gravity of 1.50 and the volume average particle diameter D50 of 135 nm (standard deviation of 28 nm).

Monodispersion spherical silica (F): The treatment with hexamethyldisilazane (HMDS) was given to silica sol obtained by a sol gel method to yield the monodispersion spherical silica (F) having the true specific gravity of 1.50 and the volume average particle diameter D50 of 100 nm (standard deviation of 40 nm).

Dry system non-spherical silica (G): The hydrophobilization treatment with hexamethyldisilazane (HMDS) was given to non-spherical fumed silica obtained by the dry system to yield the dry system non-spherical silica (G) having the true specific gravity of 2.2 and the major axis D50 of 191 nm (standard deviation of 16 nm).

Commercially available fumed silica RX50 (supplied from Nippon Aerosil Co., Ltd.): true specific gravity 2.2 and volume average particle diameter D50=40 nm (standard deviation 20 nm)

—Preparation of Carrier—

As the carrier used for the following Examples and Comparative Examples, a silicone resin coated carrier was obtained by applying a coating solution obtained by dissolving/dispersing 200 parts by mass of a silicone resin solution (supplied from Shin-Etsu Chemical Co., Ltd.) and 3 parts by mass of carbon black (supplied from Cabot) in toluene onto 2500 parts by mass of a ferrite core material by a fluidized bed spray method to coat the core material surface and then baking in an electric furnace at 300° C. for 2 hours. For carrier particle diameters, those having a relatively sharp particle diameter distribution and the average particle diameter of 30 μm to 60 μm were used.

Example 1

Preparation of Toner

[Toner A] was made by mixing 100 parts by mass of the [toner base particles A], 0.8 parts by mass of dry system hydrophobic titanium oxide (specific gravity 4.0) having the average particle diameter of 15 nm and treated with isobutyl, 1.0 part by mass of hydrophobic silica having the average particle diameter of 12 nm and treated with hexamethyldisilazane and 0.75 parts by mass of the dry system non-spherical silica (A) using Henschel mixer at a peripheral speed of 20 m/s of a stirring wing, and removing rough large powders and aggregates using a mesh with openings of 38 μm.

Example 2

Preparation of Toner

[Toner B] was made by mixing 100 parts by mass of the [toner base particles A], 0.8 parts by mass of dry system hydrophobic titanium oxide (specific gravity 4.0) having the average particle diameter of 15 nm and treated with isobutyl, 1.0 part by mass of hydrophobic silica having the average particle diameter of 12 nm and treated with hexamethyldisilazane and 0.75 parts by mass of the dry system non-spherical silica (B) using Henschel mixer at a peripheral speed of 20 m/s of a stirring wing, and removing rough large powders and aggregates using the mesh with openings of 38 μm.

Example 3

Preparation of Toner

[Toner C] was made by mixing 100 parts by mass of the [toner base particles A], 0.8 parts by mass of dry system hydrophobic titanium oxide (specific gravity 4.0) having the average particle diameter of 15 nm and treated with isobutyl, 1.0 part by mass of hydrophobic silica having the average particle diameter of 12 nm and treated with hexamethyldisilazane and 0.75 parts by mass of the dry system non-spherical silica (C) using Henschel mixer at a peripheral speed of 20 m/s of a stirring wing, and removing rough large powders and aggregates using the mesh with openings of 38 μm.

Example 4

Preparation of Toner

[Toner D] was made by mixing 100 parts by mass of the [toner base particles A], 0.8 parts by mass of dry system hydrophobic titanium oxide (specific gravity 4.0) having the average particle diameter of 15 nm and treated with isobutyl, 1.0 part by mass of hydrophobic silica having the average particle diameter of 12 nm and treated with hexamethyldisilazane and 0.75 parts by mass of the dry system non-spherical silica (D) using Henschel mixer at a peripheral speed of 20 m/s of a stirring wing, and removing rough large powders and aggregates using the mesh with openings of 38 μm.

Comparative Example 1

Preparation of Toner

[Toner E] was made by mixing 100 parts by mass of the [toner base particles A], 0.8 parts by mass of dry system hydrophobic titanium oxide (specific gravity 4.0) having the average particle diameter of 15 nm and treated with isobutyl, 1.0 part by mass of hydrophobic silica having the average particle diameter of 12 nm and treated with hexamethyldisilazane and 0.75 parts by mass of the monodispersion spherical silica (E) using Henschel mixer at a peripheral speed of 20 m/s of a stirring wing, and removing rough large powders and aggregates using the mesh with openings of 38 μm.

Comparative Example 2

Preparation of Toner

[Toner F] was made by mixing 100 parts by mass of the [toner base particles A], 0.8 parts by mass of dry system hydrophobic titanium oxide (specific gravity 4.0) having the average particle diameter of 15 nm and treated with isobutyl, 1.0 part by mass of hydrophobic silica having the average particle diameter of 12 nm and treated with hexamethyldisilazane and 0.75 parts by mass of the monodispersion spherical silica (F) using Henschel mixer at a peripheral speed of 20 m/s of a stirring wing, and removing rough large powders and aggregates using the mesh with openings of 38 μm.

Comparative Example 3

Preparation of Toner

[Toner G] was made by mixing 100 parts by mass of the [toner base particles A], 0.8 parts by mass of dry system hydrophobic titanium oxide (specific gravity 4.0) having the average particle diameter of 15 nm and treated with isobutyl, 1.0 part by mass of hydrophobic silica having the average particle diameter of 12 nm and treated with hexamethyldisilazane and 1.0 part by mass of the fumed silica RX50 (supplied from Nippon Aerosil Co., Ltd.) using Henschel mixer at a peripheral speed of 20 m/s of a stirring wing, and removing rough large powders and aggregates using the mesh with openings of 38 μm.

Comparative Example 4

Preparation of Toner

[Toner H] was made by mixing 100 parts by mass of the [toner base particles A], 0.8 parts by mass of dry system hydrophobic titanium oxide (specific gravity 4.0) having the average particle diameter of 15 nm and treated with isobutyl, 1.0 part by mass of hydrophobic silica having the average particle diameter of 12 nm and treated with hexamethyldisilazane and 0.75 parts by mass of the dry system non-spherical silica (G) using Henschel mixer at a peripheral speed of 20 m/s of a stirring wing, and removing rough large powders and aggregates using the mesh with openings of 38 μm.

Example 5

Preparation of Toner

100 Parts by mass of a binding resin (bisphenol type polyester resin containing an ethylene oxide adduct of bisphenol A and terephthalic acid as major components, weight average molecular weight=$1.1\times10^4$, number average molecular weight=$3.9\times10^3$, η (140° C.)=90 Pa·s, glass transition temperature (Tg)=65° C.), 20 parts by mass of a high melt viscosity resin (terpene modified novolak resin, weight average molecular weight=2500, Tm=165° C., η (140° C.)=85,000 Pa·s), 5 parts by mass of carbon black (BPL supplied from Cabot), 2 parts by mass of the charge controlling agent (Bontron E84 supplied from Orient Chemical Industries Ltd.) and 5 parts by mass of low molecular weight polypropylene (Viscose 660P supplied from Sanyo Chemical Industries, Ltd.) were placed in an air-cooled two roll mill, and then melted and kneaded for 15 minutes. After cooling, the mixture was finely pulverized using a jet mill and classified using a wind power classifier to yield [toner base particles B] having the volume average particle diameter of 6 μm.

[Toner I] was made by mixing 100 parts by mass of the [toner base particles B], 0.8 parts by mass of dry system hydrophobic titanium oxide (specific gravity 4.0) having the average particle diameter of 15 nm and treated with isobutyl, 1.0 part by mass of hydrophobic silica having the average particle diameter of 12 nm and treated with hexamethyldisilazane and 0.75 parts by mass of the dry system non-spherical silica (A) using Henschel mixer at a peripheral speed of 20 m/s of a stirring wing, and removing rough large powders and aggregates using the mesh with openings of 38 μm.

<Image Formation>

In Examples and Comparative Examples, the image was formed using the following image forming apparatus.

In this image forming apparatus, in vicinity of or in contact with the photoconductor drum which is the image bearing member, the charging roller which charges the even charge on the photoconductor drum, the exposing apparatus which is the exposing unit for forming the latent electrostatic image on the photoconductor drum, the developing apparatus which elicits the latent electrostatic image to make the toner image, the transfer belt which transfers the toner image on the transfer paper, the cleaning apparatus which removes the toner left on the photoconductor drum, the electricity removing lamp which removes the residual electricity on the photoconductor drum, and a photo sensor which controls the voltage applied to the charging roller and the toner concentration in the development are disposed. The toner of Example or Comparative Example is resupplied from a toner resupply apparatus to this developing apparatus through a toner resupply inlet. Making the image is performed as follows. The photoconductor is rotated in an anticlockwise direction. On the photoconductor drum, the electricity is removed by electricity removing light, and a surface potential is averaged to a standard potential of 0 to −150 V. Subsequently, the surface is charged by the charging roller to make the surface potential around −1000 V. Then, the surface is exposed by the exposing apparatus, and the surface potential on the portion (Image portion) irradiated with the light becomes 0 to −200 V. The toner on the sleeve adheres to the image portion by the developing apparatus. The photoconductor on which the toner image has been made is rotated and moved. The transfer paper is send from a paper supply section in the timing so that a tip of the paper and a tip of the image are matched at the transfer belt, and the toner image on the photoconductor drum is transferred onto the transfer paper by the transfer belt. Subsequently, the transfer paper is sent to the fixing section, and the toner is fusion-bonded by heat and pressure. Then the paper is discharged as a copy. The residual toner left on the photoconductor drum is scraped by the cleaning blade in the cleaning apparatus. Subsequently, the residual electricity left on the photoconductor is removed by the electricity removing light to back to an initial state and prepare for the subsequent image making step.

Using the above image forming apparatus, for the toners and the developers of Examples and Comparative Examples, the following parameters were evaluated. Results are shown in Table 2.

<Cleaning Ability>

The cleaning ability was evaluated as follows. In a test room at temperature/humidity of 10° C./15% RH, using the above image forming apparatus, 5,000 sheets were passed, subsequently the machine was stopped during passing a white image, a transfer residual toner left on the photoconductor passed through the cleaning step was transferred onto a white paper via Scotch tape (supplied from Sumitomo 3M Ltd.), which was then measured by Macbeth reflection densitometer RD514 type, and evaluated by the following criteria.

[Evaluation Criteria]

A: the difference from a blank is less than 0.01 and the cleaning ability is good;

B: the difference from the blank is 0.01 to 0.02 and the cleaning ability is not good but acceptable; and C: the difference from the blank is more than 0.02 and the cleaning ability is poor.

<Image Quality>

For the image quality, image quality deterioration (specifically, transfer fault and scumming image occurrence) of the image after passing the papers was totally determined. Using the above image forming apparatus, 5,000 sheets were passed, subsequently a black solid image was passed, and for the resulting image, a transfer fault level was determined by visually ranking.

For the scumming image, using the above image forming apparatus, 5,000 sheets were passed, subsequently the machine was stopped during developing a white paper image, the developer on the photoconductor after the development was transferred onto a tape, and the difference from the image density of a not transferred tape was measured by a spectro densitometer (supplied from X-Rite), and evaluated by the following criteria.

[Evaluation Criteria]

A: the difference is less than 0.30; and

C: the difference is 0.30 or more.

[Image Quality Evaluation Criteria]

A: the image quality is good;

B: the image quality is not good but practically acceptable; and

C: the image quality is poor and practically unacceptable.

<Stress Durability Resistance>

In a 50 mL screw vial, 10 g of the toner and 20 g of the carrier (TEFV23 supplied from Powdertech) were placed, and shaken at maximum vibration frequency using a locking mill (supplied from Seiwa Giken Co., Ltd.) for 60 minutes. Subsequently, the carrier and the toner were separated using a sieve with openings of 38 μm to yield the stress-given toner. Residual large particle diameter particles left in the toner were observed using a scanning electron microscope (SEM), and the difference before and after applying the stress was evaluated by the following criteria.

[Evaluation Criteria]

A: embedding and migration to concave portions of the additive are scarcely observed, which is good;

B: the additive is slightly embedded and slightly migrates to the concave portions; and C: the additive is embedded and fairly migrates to the concave portions.

TABLE 2

| | Toner | Cleaning ability | Image quality | Stress durability resistance |
|---|---|---|---|---|
| Example 1 | A | A | A | A |
| Example 2 | B | B | A | A |
| Example 3 | C | B | A | A |
| Example 4 | D | A | A | B |
| Comparative Example 1 | E | A | A | C |
| Comparative Example 2 | F | B | A | C |
| Comparative Example 3 | G | C | A | C |
| Comparative Example 4 | H | C | C | A |
| Example 5 | I | A | B | A |

The toner of the present invention combines the excellent cleaning ability, image quality and durability, and thus is suitably used for copy machines, laser printers and plain paper facsimiles using the direct or indirect electrographic development system, and full color copy machines, full color laser printers and full color plain paper facsimiles using the direct or indirect electrographic multicolor development system.

The developer, the vessel with toner, the process cartridge, the image forming apparatus and the image forming method of the present invention using the toner of the present invention are suitably used for the image formation with high quality.

What is claimed is:

1. A toner comprising a toner base particle which comprises at least a binding resin and a colorant, and an external additive, wherein the external additive is a non-spherical amorphous silica particle obtained by sintering multiple particles and a major axis of the silica particle is 40 nm to 180 nm.

2. The toner according to claim 1, wherein the major axis of said non-spherical amorphous silica particle is 60 nm to 140 nm.

3. The toner according to claim 1, wherein said non-spherical amorphous silica particle has a true specific gravity of 1.8 to 2.3 and the silica particle is hydrophobilized wherein a hydrophobilization degree is 40 or more.

4. The toner according to claim 1, wherein said non-spherical amorphous silica particle is produced by a dry system and a mass reduction rate when the silica particle is heated from 30° C. up to 250° C. is 5% by mass or less.

5. The toner according to claim 1, containing at least one external additive having BET specific surface area of 20 $m^2/g$ to 300 $m^2/g$ besides said non-spherical amorphous silica particle.

6. The toner according to claim 1, wherein the external additive besides said non-spherical amorphous silica particle is at least one selected from silica, titanium compounds, alumina, cerium oxide, calcium carbonate, magnesium carbonate, calcium phosphate, fluorine-containing resin fine particles, silica-containing resin fine particles, and nitrogen-containing resin fine particles.

7. The toner according to claim 6, wherein said titanium compound is a titanium compound obtained by reacting at least a part of $TiO(OH)_2$ produced by a wet system with either a silane compound or a silicone oil.

8. The toner according to claim 6, wherein a specific gravity of said titanium compound is 2.8 to 3.6.

9. The toner according to claim 1 obtained by emulsifying or dispersing a solution or a dispersion of toner materials in a water-based medium, and subsequently granulating the toner.

10. The toner according to claim 9, wherein the toner materials contains a compound containing an active hydrogen group and a polymer capable of reacting with the compound containing the active hydrogen group, and wherein granulation is performed by reacting said compound containing the active hydrogen group with the polymer capable of reacting with the compound containing the active hydrogen group to generate an adhesive substrate and obtaining particles comprising at least the adhesive substrate.

11. The toner according to claim 9, wherein a solution or a dispersion of toner materials is prepared by dissolving or dispersing the toner materials in an organic solvent.

12. The toner according to claim 1, wherein the toner is obtained by melting and kneading, and pulverizing the toner material containing at least the binding resin and the colorant.

13. A two-component developer composed of a toner and a carrier, wherein the toner comprises a toner base particle which comprises at least a binding resin and a colorant, and an external additive, wherein an external additive is a non-spherical amorphous silica particle and a major axis of the silica particle is 40 nm to 180 nm.

14. An image forming method comprising a latent electrostatic image forming step of forming a latent electrostatic image on a latent electrostatic image bearing member, a developing step of developing said latent electrostatic image using a toner to form a visible image, a transferring step of transferring said visible image on a recording medium and a fixing step of fixing a transfer image transferred onto the recording medium, wherein the toner comprises a toner base particle which comprises at least a binding resin and a colorant, and an external additive, wherein an external additive is a non-spherical amorphous silica particle and a major axis of the silica particle is 40 nm to 180 nm.

* * * * *